United States Patent [19]

Grecksch et al.

[11] Patent Number: 5,044,572

[45] Date of Patent: Sep. 3, 1991

[54] YARN UNWINDING GUIDE APPARATUS FOR A TEXTILE WINDING MACHINE

[75] Inventors: Hans Grecksch; Dietmar Engelhardt, both of Monchen-Gladbach, Fed. Rep. of Germany

[73] Assignee: W. Schlafhorst & Co., Fed. Rep. of Germany

[21] Appl. No.: 456,382

[22] Filed: Dec. 26, 1989

[30] Foreign Application Priority Data

Dec. 23, 1988 [DE] Fed. Rep. of Germany ..... 3843553

[51] Int. Cl.[5] ..... B65H 54/20; B65H 67/02; B65H 49/00

[52] U.S. Cl. ..... 242/35.5 R; 242/35.50 A; 242/35.60 R; 242/128

[58] Field of Search ..... 242/35.5 R, 35.5 A, 242/35.6 R, 35.6 E, 18 R, 128

[56] References Cited

U.S. PATENT DOCUMENTS

| | | | |
|---|---|---|---|
| 2,743,877 | 5/1956 | Furst | 242/35.6 R |
| 2,769,599 | 11/1956 | Furst | 242/35.6 R |
| 2,994,491 | 8/1961 | Weber | 242/128 |
| 3,011,736 | 12/1961 | Furst et al. | 242/128 |
| 3,031,149 | 4/1962 | Furst et al. | 242/35.6 R |
| 3,074,660 | 1/1963 | Furst | 242/35.6 R |
| 3,077,312 | 2/1963 | Furst | 242/35.6 R |
| 3,198,446 | 8/1965 | Furst et al. | 242/35.6 R |
| 4,570,867 | 2/1986 | Kohlen | 242/35.6 R |
| 4,597,540 | 7/1986 | Kiriake | 242/35.5 R X |
| 4,673,138 | 6/1987 | Ichiba | 242/35.5 R |
| 4,901,931 | 2/1990 | Mista | 242/35.6 E X |
| 4,911,371 | 3/1990 | Mista | 242/35.6 E |
| 4,921,179 | 5/1990 | Surkamp et al. | 242/35.6 E X |

*Primary Examiner*—Stanley N. Gilreath

*Attorney, Agent, or Firm*—Shefte, Pinckney & Sawyer

[57] ABSTRACT

An apparatus for handling yarn during axial unwinding of the yarn from a yarn package at an unwinding device of a textile machine includes a device for restricting laterally outward displacement of the yarn. The restricting device is mounted to at least one of a pair of chamber portions which surround the yarn package during unwinding of yarn therefrom and preferably includes a vertically extending plate shaped to define a yarn receiving area for confining the path of the yarn being unwound. The plate guides the yarn from the inner wall of the chamber formed by the chamber portions into the yarn receiving area. According to another aspect of the invention, a device is provided for engaging a traveling yarn during unwinding of the yarn from a yarn package to eliminate loops, snarls and the like. The engaging device includes a pair of arm members, a pivot assembly for pivotally supporting the arm members for posed pivoting movement and a component for pivoting the arm members toward one another into a guiding position for guiding the traveling yarn and for pivoting the arm members away from one another to a non-engaging position.

27 Claims, 15 Drawing Sheets

FIG. 15
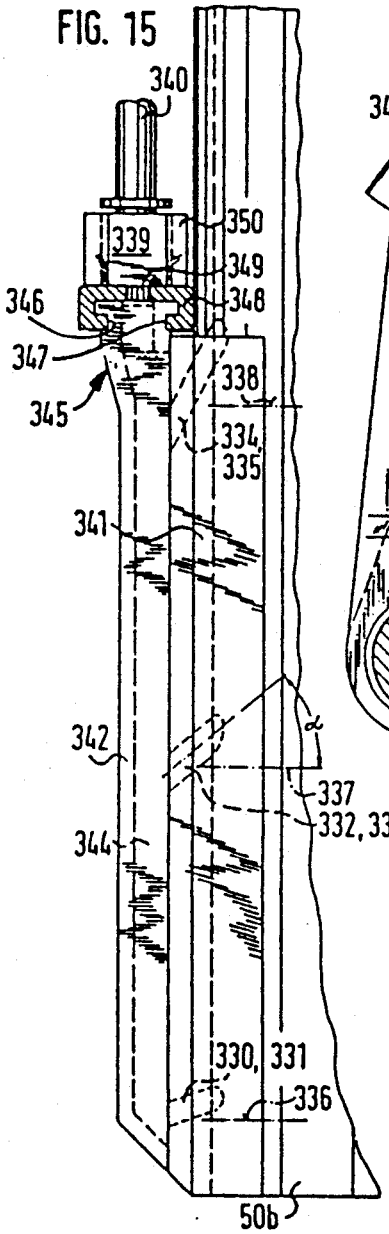
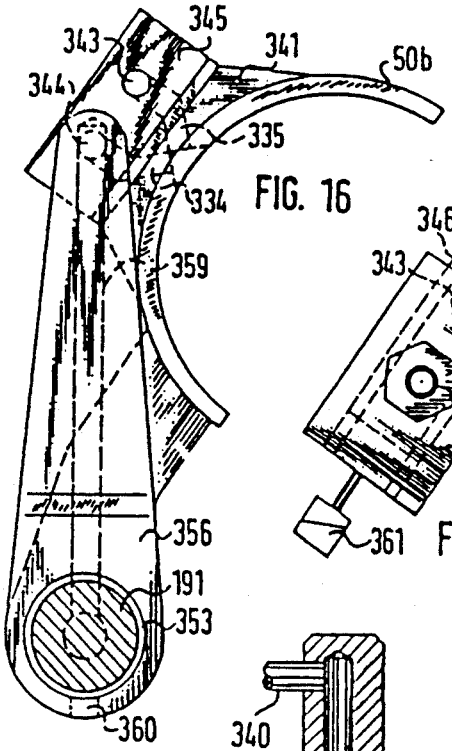
FIG. 16
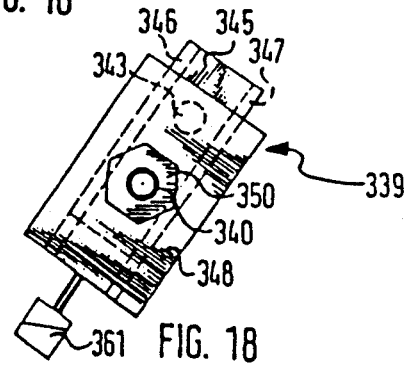
FIG. 18
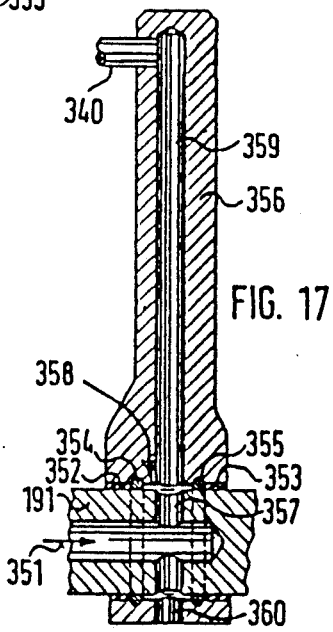
FIG. 17

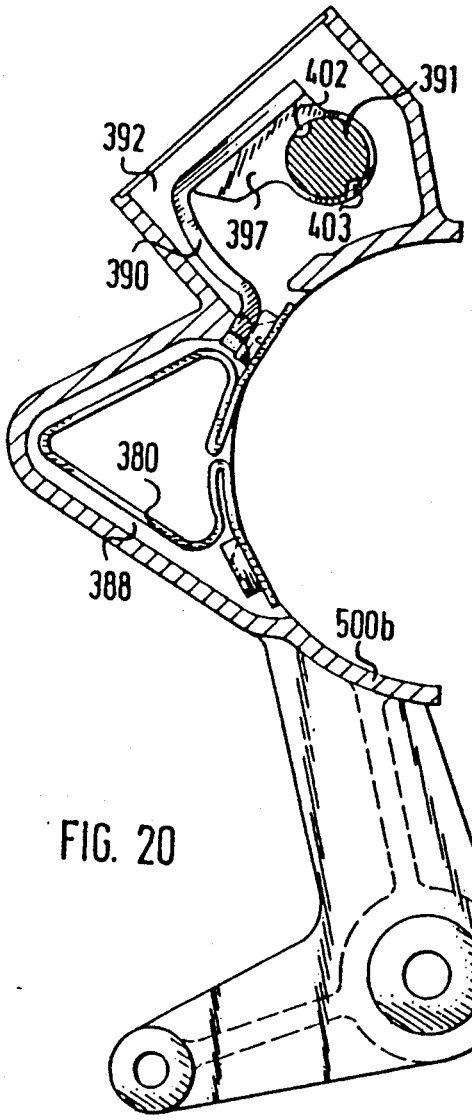
FIG. 20
FIG. 21
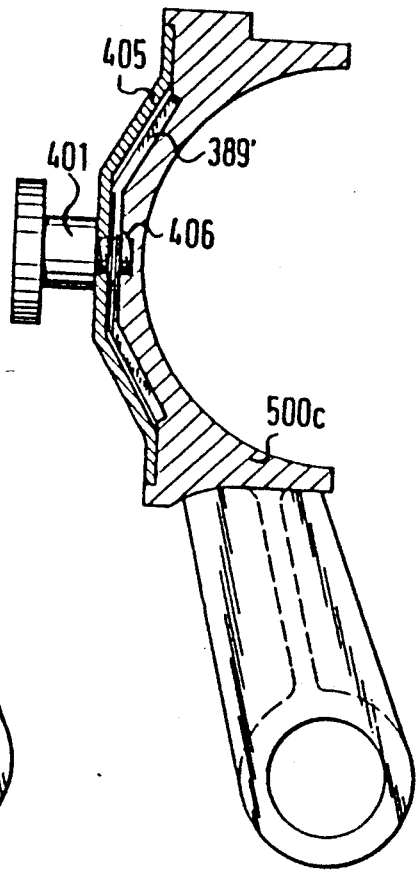

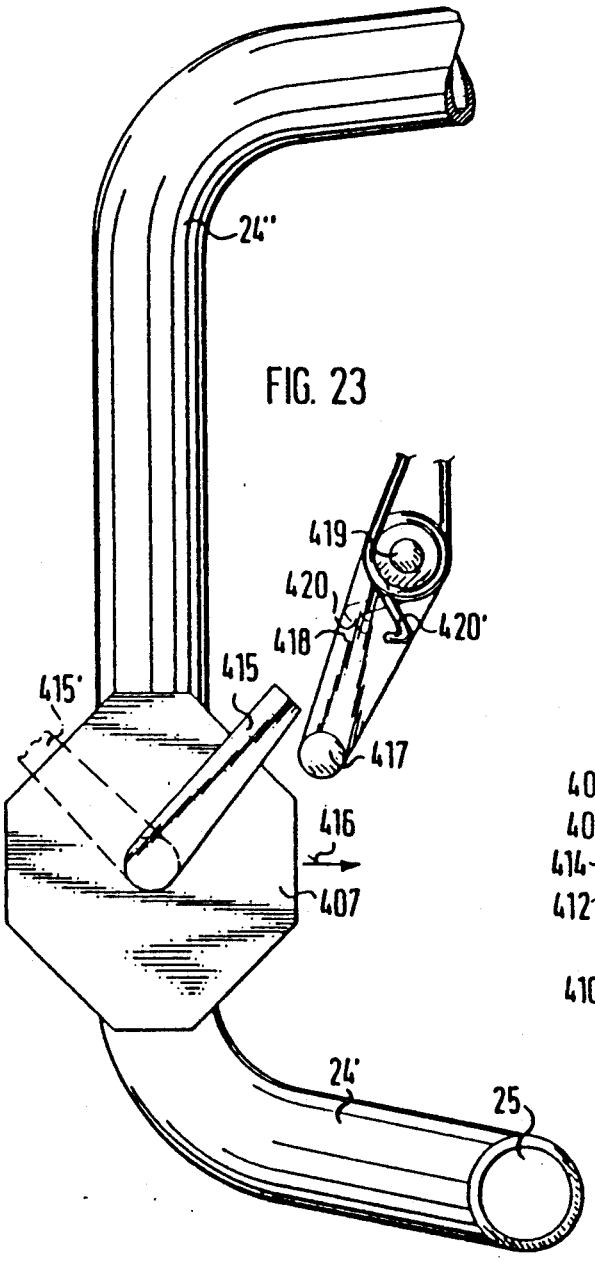
FIG. 23
FIG. 24
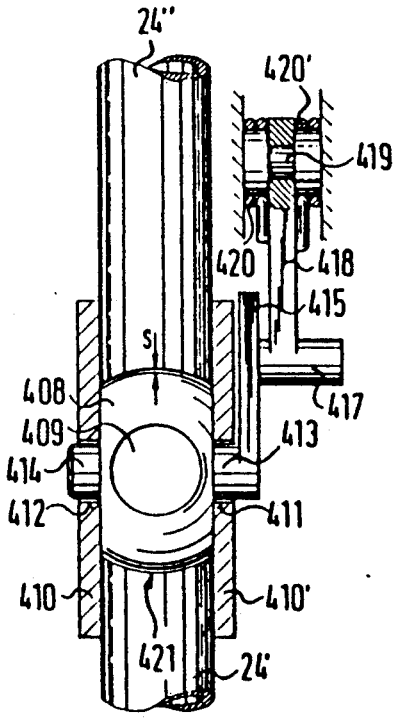

YARN UNWINDING GUIDE APPARATUS FOR A TEXTILE WINDING MACHINE

BACKGROUND OF THE INVENTION

The present invention relates to a yarn unwinding guide for a textile winding machine and, more particularly, to a yarn unwinding guide for guiding yarn being unwound from a package built on a tube which is individually supported on a tube support member.

It is known to provide a textile winding machine with a plurality of independently movable tube support members and to transfer yarn packages comprising yarn built on tubes from a yarn package storage location onto the tube support members. The tube support members typically include an upright member for receiving a tube inserted thereon to support the tube in a generally upright disposition. The tube support members are typically moved in a path which initially leads to a yarn end preparation machine which loosens the yarn end of each package, without regard to the location of the yarn end on the package, and disposes the yarn end in a preferred preliminary position such as, for example, in a bottom winding around the bottom portion of the tube. From there, the tube support members are transported to an unwinding machine in which the yarn packages are unwound from the tubes. Following the unwinding operation, the tube support members, with empty tubes supported thereon, are transported to a tube removal location for removing the empty tubes. Those tube support members from which a tube has been removed are then returned to the tube transfer location for the insertion of a new yarn package thereon.

However, sometimes tube support members are transported to the unwinding location having yarn packages thereon which have not undergone the process of disposing the yarn end of the package in a preferred preliminary disposition. In this situation, a yarn end may be located at any one of an infinite number of random locations on the yarn package. To initiate the unwinding process, the yarn end must first be loosened from the yarn package and guided to an appropriate yarn draw-off component of the winding machine.

One device for unwinding a yarn end from a yarn package supported on an upright tube includes a gas guide chamber into which streams of gas are introduced for producing a helical flow pattern about the yarn package to thereby facilitate unwinding of the yarn end. Once the yarn end has been propelled beyond the top of the gas guide chamber, an appropriate yarn engaging device such as, for example, a suction device, engages the yarn end and guides the yarn end to an appropriate yarn draw-off component of the winding machine. Thereafter, the yarn travels continuously upwardly beyond the top of the gas guide chamber as it is continuously fed to a yarn traversing mechanism for building a cross-wound yarn package. However, the yarn may not be constrained during its travel through an extent extending from the top of the gas guide chamber to the first component of the yarn feeding device which contacts the traveling yarn after it exits the gas guide chamber. Thus, the risk exists that detrimental uncontrolled ballooning of traveling yarn will occur as it travels through this unconstrained extent. Accordingly, the need exists for an apparatus which effectively and reliably guides a traveling yarn as it travels beyond the top of a gas guide chamber.

SUMMARY OF THE INVENTION

The present invention provides a yarn unwinding guide for effectively and reliably controlling the ballooning characteristics of a yarn traveling beyond the top of a gas guide chamber of a textile winding machine.

According to one aspect of the present invention, there is provided, in a textile machine of the type having a plurality of independently movable tube support members for individually supporting tubes in generally upright dispositions, an unwinding device for unwinding, at an unwinding location, packages of textile material such as yarn or the like wound on tubes supported on the tube support members, a delivery assembly for delivering the tube support members to a preliminary location for feeding to the unwinding device, a discharge assembly for transporting tube support members from a discharge location to a further handling location and a yarn end loosening assembly having means for emitting streams of gas, a pair of chamber portions and means for moving the chamber portions between a clearance position for travel therepast of a tube support member along a cross path extending through the unwinding device and a chamber forming position in which the chamber portions are cooperatively disposed relative to one another to form a gas guide chamber at the unwinding location, the gas guide chamber encircling a yarn package supported by a tube support member to guide against the yarn package streams of gas emitted by the gas stream emitting means for loosening a yarn end of the yarn package, an apparatus for handling yarn during axial unwinding of the yarn from a yarn package in the gas guide chamber to control ballooning of the yarn. The apparatus includes means mounted to at least one of the chamber portions for restricting laterally outward displacement of the yarn relative to the axis of unwinding at a location between the end of the tube and generally the top of the gas guide chamber, said restricting means including vertically extending plate means shaped to define a yarn receiving area within the lateral extent of the gas guide chamber for confining the path of the yarn being unwound, said plate means including means for guiding the yarn from the inner wall of the gas guide chamber into said yarn receiving area.

According to the one aspect of the present invention, the guiding means includes a first guide surface and a second guide surface forming a vertical opening therebetween and the plate means includes a surface extending continuously from the first guide surface to the second guide surface and defining the yarn receiving area. According to further features of the one aspect of the present invention, the first and second guide surfaces define a concave segment and the vertical spacing is formed generally at the midpoint of the concave segment, the first and second guide surfaces guiding the yarn toward the vertical opening.

In another aspect, the present invention also includes, in a textile machine wherein the unwinding device includes a yarn end engagement member for engaging a yarn end at a location above the gas guide chamber and for moving the engaged yarn in a lateral direction across the lateral extent of the gas guide chamber, the further features in which the guiding means includes a first guide member and a second guide member spaced from one another to form a vertical opening permitting access into the yarn receiving area, the yarn end engagement member moving the engaged yarn into engagement with the first guide member through movement of the engaged yarn in the lateral direction, the second guide member extending laterally outwardly from the first guide member for engaging a yarn traveling beyond the first guide member to guide the yarn through the vertical opening into the yarn receiving area. Additionally, the first guide member is inclined in the lateral direction for urging a yarn traveling therealong toward the second guide member.

According to further features of the another aspect of the present invention the first guide means is shaped to form three sides of a four sided yarn receiving area and the second guide member is shaped to form the fourth side of the four sided yarn receiving area. Also, the second guide means is shaped to form two tines of a fork and the first guide means extends across the tines and forms the vertical opening with one of the tines.

According to an additional aspect of the present invention, there is provided means for moving the plate means laterally outwardly to an inoperative position out of yarn engagement. Also, the present invention includes, in a textile machine wherein the chamber has an inner circumferential wall, the further features that the restricting means includes a pair of contoured members and the moving means includes means for moving the contoured members, each contoured member having an inner surface adapted to face the inner surface of the other contoured member and an outer surface having a curvature generally corresponding to the curvature of the inner circumferential wall of the gas guide chamber, the moving means moving the contoured members between the inoperative position in which the outer surfaces of the contoured members are in generally flush relation with the inner circumferential wall of the gas guide chamber and a yarn receiving area forming position in which the inner surfaces of the contoured members face one another to form a yarn receiving area.

According to other features of the additional aspect of the present invention, there is provided, in a textile machine wherein the unwinding device includes a tube stabilizing assembly having an arm member and an opposing member, the arm member being movable against a selected one of the tube and the tube support member and the opposing member engaging a selected one of the tube and the tube support member to stabilize the tube during the unwinding of yarn therefrom, the features that the moving means includes at least one vertical shaft pivotally supported on one of the chamber portions, a respective one of the contoured members being connected to the vertical shaft for pivotal movement therewith, and means for pivoting the vertical shaft in response to movement of the arm member of the tube stabilizing assembly to effect movement of the respective contoured member between the inoperative position and the yarn receiving area forming position. Moreover, the pivoting means includes a cam assembly having a cam member mounted to a selected one of the vertical shaft and the arm member and a cam follower member mounted to the other of the vertical shaft and the arm member, the cam assembly translating pivotal movement of the arm member to the vertical shaft.

In the additional aspect of the present invention, there is also provided, in a textile machine wherein the chamber portions include at least one slot in a respective chamber portion, the features that the restricting means includes means for supporting the plate means on the respective chamber portion outwardly of the gas guide chamber and extending through the slot into the gas guide chamber. Further, the supporting means preferably includes at least one vertical shaft pivotably supported on the respective chamber portion, the plate means is connected by connecting means to the vertical shaft for pivoting therewith and the moving means includes means for pivoting the vertical shaft to effect movement of the plate means between the inoperative position and the yarn receiving area forming position. Additionally, the yarn handling apparatus includes means for selectively adjusting the axial position of the plate means on the vertical shaft.

With further regard to the additional aspect of the present invention, the restricting means, in one variation, include at least one offset formed in the respective chamber portion to form a recess for receiving the extent of the plate means outwardly of the slot in the gas guide chamber. In another variation, the restricting means include at least one offset formed in the respective chamber portion to form a recess for receiving the extent of the plate means outwardly of the slot in the gas guide chamber, and the pivoting means is operable to pivot the plate means from the yarn receiving area forming position through the slot into the offset for disposition of the plate means therein in the inoperative position.

In a further variation, the restricting means include at least one offset formed in the respective chamber portion to form a recess for receiving the extent of the plate means outwardly of the slot in the gas guide chamber, and the pivoting means is operable to pivot the plate means from the yarn receiving area forming position through the slot into the offset for disposition of the plate means therein in the inoperative position and the means for adjusting the axial position of the plate means includes a height adjustment assembly movably connected to the respective chamber portion for axial movement relative thereto, the height adjustment assembly engaging the plate means to support the plate means at selected axial positions along the vertical shaft. Preferably, in the further variation, the height adjustment assembly is disposed inwardly of the inner circumferential wall of the gas guide chamber and is formed with a curvature compatibly configured with the curvature of the inner circumferential wall.

In yet a further aspect of the present invention, an apparatus is provided for a textile machine of the type having a plurality of independently movable tube support members for individually supporting tubes in generally upright dispositions, an unwinding device for unwinding, at an unwinding location, packages of textile material such as yarn or the like wound on tubes supported on the tube support members, a delivery assembly for delivering the tube support members to a preliminary location for feeding to the unwinding device, a discharge assembly for transporting tube support members from a discharge location to a further handling location and a yarn end engagement assembly including a movable suction tube communicated with a source of suction and having an open end for applying a suction flow therethrough at a yarn end drawing location to draw a yarn end of a wound package at the unwinding location into the suction tube for movement of the yarn end by the suction tube to a yarn splicing location and means for moving the suction tube between the yarn end drawing location and the yarn splicing location. The apparatus for stopping the suction applied through the open end of the suction tube in response to movement of the suction tube includes valve means including a throughbore, the valve means being pivotally mounted within the suction tube between the open end and the suction source for movement between a suction applying position in which the throughbore communicates the open end of the suction tube with the suction source and a stopping position in which the valve means restricts the passage of the suction flow therepast and actuating means including a pivot lever connected to the valve means and a pivot lever engaging assembly for engaging the pivot lever during the movement of the suction tube therepast to effect movement of the valve means between the suction applying position and the stopping position.

According to an additional feature in the further aspect of the present invention, the valve means includes a ball valve member having the throughbore formed therethrough, the ball valve member having an outer surface portion compatibly configured with the suction tube and forming a clamping passage therewith and the ball valve member and the suction tube compressively securing a yarn end drawn into the clamping passage during movement of the valve means between the suction applying position and the stopping position.

In yet another aspect of the present invention, there is provided, in a textile machine of the type having a plurality of independently movable tube support members for individually supporting tubes in generally upright dispositions, an unwinding device for unwinding, at an unwinding location, packages of textile material such as yarn or the like wound on tubes supported on the tube support members, a delivery assembly for delivering the tube support members to a preliminary location for feeding to the unwinding device, a discharge assembly for transporting tube support members from a discharge location to a further handling location and a yarn end loosening assembly having means for emitting streams of gas, a pair of chamber portions and means for moving the chamber portions between a clearance position for travel therepast of a tube support member along a cross path extending through the unwinding device and a chamber forming position in which the chamber portions are cooperatively disposed relative to one another to form a gas guide chamber at the unwinding location, the gas guide chamber encircling a yarn package supported by a tube support member to guide against the yarn packages streams of gas emitted by the gas stream emitting means for loosening a yarn end of the yarn package, an apparatus for handling yarn traveling from the gas guide chamber. The apparatus includes means for engaging the traveling yarn to eliminate loops, snarls and the like, said engaging means including a pair of arm members, a pivot assembly for pivotally supporting said arms for opposed pivoting movement in a horizontal plane above the gas guide chamber, and means for pivoting said arm members toward one another into a guiding position in which said arm members form a yarn guiding opening therebetween for guiding of the traveling yarn and for pivoting said arm members away from one another to a non-engaging position, each arm member having a recess for cooperating with the recess of the other arm member to form said yarn guiding opening for guiding of the traveling yarn.

According to further features of the engaging means, the arm members partially overlap one another in the guiding position, one of the arm members includes a vertically extending stop portion and the other arm member includes an engaging portion for engaging the vertically extending stop portion of the one arm member to limit the extent of overlapping of the arm members. Also, the recesses of the arm members partially overlap in the guiding position.

The engaging means also preferably is configured such that the pivoting means includes a drive gear fixedly connected to one of the arm members, a driven gear fixedly connected to the other arm member, the drive gear and the driven gears being disposed in meshing engagement with one another to drivingly interconnect the arm members for synchronous pivoting movement, and means for driving the one arm member. Also, the one arm member driving means is, in one variation, operable to move the arm members from the guiding position to the non-engaging position in response to sensing of predetermined characteristics of the yarn.

The yarn handling also preferably includes, in addition to the engaging means, a yarn shearing assembly for shearing yarn traveling beyond the arm members. The yarn shearing assembly is preferably mounted to one of the arm members.

BRIEF DESCRIPTION OF THE DRAWINGS

FIG. 15 is a side elevational view, in partial vertical section, of a portion of one type of a gas guide chamber of a textile winding machine;

FIG. 16 is a top plan view of the gas guide chamber shown in FIG. 15;

FIG. 17 is a vertical sectional view of a portion of the gas guide chamber shown in FIGS. 15 and 16;

FIG. 18 is a top plan view of the reversing valve of the gas guide chamber shown in FIGS. 15 and 16;

FIG. 20 is a horizontal sectional view of the yarn unwinding guide apparatus shown in FIG. 19;

FIG. 21 is a horizontal sectional view of a variation of the yarn unwinding guide apparatus shown in FIGS. 19 and 20;

FIG. 23 is a side elevational view of a yarn clamp assembly of the textile winding machine shown in FIG. 1; and FIG. 24 is a vertical sectional view of the yarn clamp assembly shown in FIG. 23.

DETAILED DESCRIPTION OF THE PREFERRED EMBODIMENTS

Figure 1:
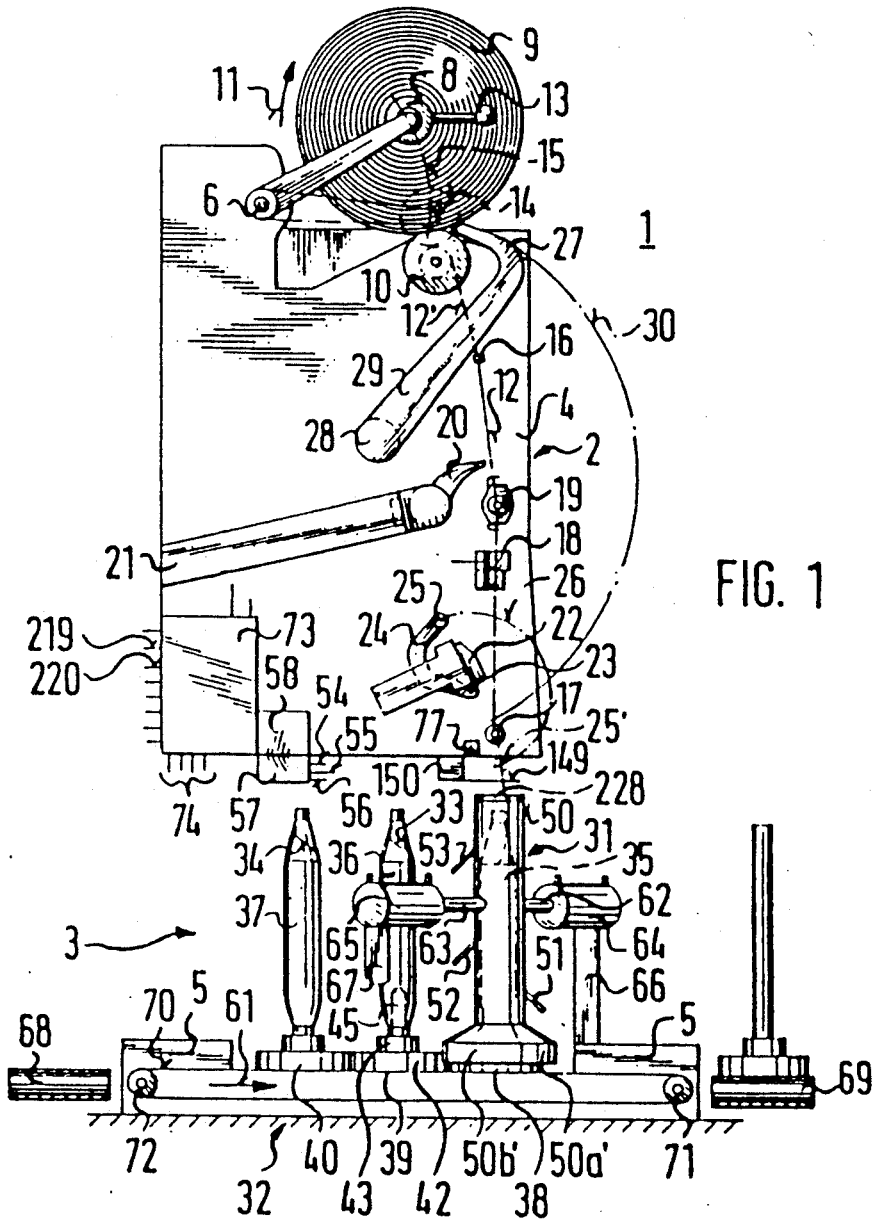
FIG. 1 is a side elevational view of a textile winding machine having a transport assembly for transporting independently movable tube support members to an unwinding location and embodying one embodiment of the yarn unwinding guide apparatus of the present invention.

In FIG. 1, a winding station 2 of a winding machine is seen to include a rocking shaft 6 of a creel 8 mounted on a machine frame 4 and carrying the tube of a crosswound bobbin 9. The bobbin 9 is in contact with a yarn guide drum 10 and is driven by the yarn guide drum 10 by means of friction in the direction indicated by the arrow 11. The yarn guide drum 10 is provided with reversing thread grooves for guiding a yarn 12 from package being unwound at the unwinding location onto the bobbin 9 as a crosswound bobbin. The creel 8 is raised by a handle 13 to lift the bobbin 9 off the yarn guide drum 10.

At the start of winding, an empty tube 14 is clamped into the creel 7, as is shown in FIG. 1 in dotted lines. As the bobbin 9 is built, the creel 8 pivots upward along a circular arc 15.

The yarn 12 is supplied to the yarn guide drum 10 through a yarn eyelet 16. Yarn 12 traverses along a path 12' as it travels between the yarn eyelet 16 and the yarn guide drum 10.

As it comes from the yarn supply unit 3, yarn 12 runs through a conventional yarn tensioner 17, a conventional clearer 18 and a conventional waxing device 19 before it reaches yarn eyelet 16. In the event of a yarn break, the yarn can be drawn into a suction nozzle 20 which is connected to a conventional suction source 21.

To restore a yarn connection after a yarn break, a conventional splicing device 22 is located to the side of the yarn or thread course between the yarn tensioner 17 and the clearer 18. This splicing device 22 operates automatically in a conventional manner.

After a yarn break, the incoming yarn end is usually still present under the yarn tensioner 17. It is caught there for the purpose of splicing by a conventional yarn receiving element in the shape of a suction tube 24 which can pivot about a pivot 23 and whose suction intake mouth 25 is pivoted along circular arc 26 below the yarn tensioner 17 and back again into the initial position.

The upper yarn end has usually been wound onto the winding bobbin 9 after a yarn break. It is drawn in by suction by a suction intake nozzle 27 of a suction tube 29, which pivots about a pivot point 28. When the suction tube 29 is pivoted downward, the suction intake nozzle 27 moves with the attracted upper yarn along a circular arc 30. The entrained yarn is threaded thereby into the reversing thread groove of the yarn guide drum 10, the yarn eyelet 16, the waxing device 19 and the measuring slot of the clearer 18. It is also grasped by a conventional grasping means (not shown) of the splicing device 22 adjacent the lower yarn held by the suction intake mouth 25 of the suction tube 24. Immediately after restoration of the splicing connection, the splicing device 22 frees the yarn for resumption of the winding operation.

The winding station 2 includes a plurality of independently movable tube support members 38,39 and 40 for individually supporting a plurality of yarn packages 35,36 and 37, respectively, which comprise yarn built on an individual tube. Each yarn package 35–37 includes an upper reserve winding such as, for example, the upper reserve windings 33 and 34 on the yarn packages 36 and 37, respectively. As seen in FIG. 1, each tube support member 38,39,40, such as, for example, the tube support member 38, includes a cylindrical base plate 42, a top cylindrical plate 43 and a cylindrical upright component 45. The plates 42 and 43 and the upright cylindrical component 45 being coaxial. The upright component 45 has an outer diameter compatibly configured with respect to the inner diameter of the tubes onto which the yarn of the yarn packages 35–37 is built. Accordingly, the tube support members 38–40 individually support the yarn packages 35–37 in an upright disposition.

As seen in FIG. 1, the winding station 2 includes a conventional delivery assembly 68 having an endless belt for delivering the tube support members 38–40 to a preliminary location, a conventional discharge assembly 69 having an endless belt for transporting the tube support members 38–40 from a discharge location to a further handling location (not shown) and a cross-transport assembly 32 for transporting the tube support members 38–40 along a cross path extending from the preliminary location through an unwinding location to the discharge location. The cross-transport assembly 32 transports the tube support members 38–40, with the yarn packages 35–37 supported in upright dispositions thereon, to the unwinding location for individual unwinding of the yarn packages at the winding station 2.

The cross-transport assembly 32 includes an endless belt 70 trained around a pair of guide rollers 71,72 and driven by a conventional endless belt drive motor (not shown) in the direction indicated by the arrow 61 in FIG. 1. The junction of the delivery assembly 68 and the cross-transport assembly 32 defines the preliminary location. The tube support members 38–40 are transferred from the endless belt of the delivery assembly 68 to the endless belt 70 of the cross-transport assembly 32, at the preliminary location, in conventional manner. The junction of the endless belt of the discharge assembly 69 and the endless belt 70 of the cross-transport assembly 32 defines the discharge location. The tube support members 38–40 are transferred from the endless belt 70 of the cross-transport assembly 32 to the endless belt of the discharge assembly 69, at the discharge location, in conventional manner.

As seen in FIG. 1, the yarn end loosening apparatus 31 includes a support frame 5, a first support post 66 extending vertically from the support frame 5 and supporting a first movement means 64, a connector 62 and a first chamber portion 50*a* and a second support post 67 supporting a second movement means 65, a second connector 63 and a second chamber portion 50*b*. The first chamber portion 50*a* and the second chamber portion 50*b* form a gas guide chamber 50 when they are in mating contact with one another. The first movement means 64 and the second movement means 65 are each configured as a conventional hydraulic cylinder actuable to selectively retract and extend the respective associated connector 62 or 63, which are each configured as conventional hydraulic cylinder rods. The first movement means 64 and the second movement means 65 are each operatively connected by a plurality of conventional connectors 74 to a conventional central control unit 73 mounted to the winding station 2. The connector 74 can be, for example, flexible pneumatic conduits.

The first chamber portion 50*a* is fixedly connected to the free end of the connector 62. The second chamber portion 50*b* is fixedly connected to the free end of the connector 63. As seen in FIG. 1, the first chamber portion 50*a* and the second chamber portion 50*b* support a plurality of jet nozzles 51,52 and 53 which are operatively connected by a plurality of flexible conduits 54,55 and 56, respectively, to a conventional regulating valve 57. The regulating valve 57 regulates the outflow of compressed gas from a conventional compressed gas source 58 operatively connected to the central control unit 73. The jet nozzles 51,52 and 53 direct jet streams of gas, which are supplied via the conduits 54,55 and 56 from the compressed gas source 58, against a yarn package positioned between the first chamber portion 50*a* and the second chamber portion 50*b* to loosen a yarn end on the yarn package, as described in more detail below.

Figure 12:
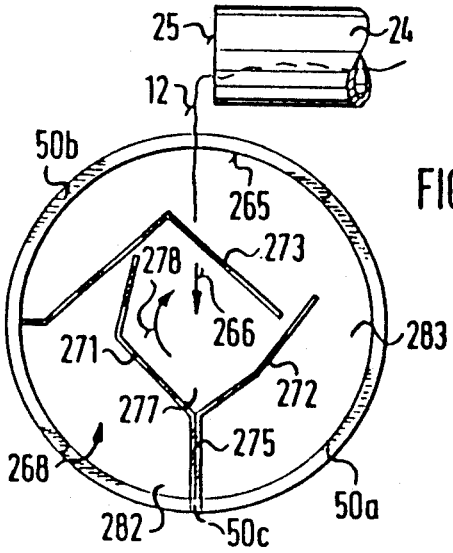
FIG. 12 is a top plan view of another additional embodiment of the yarn unwinding guide apparatus of the present invention.

As seen in FIG. 12, the first chamber portion 50*a* and the second chamber portion 50*b* are respectively movable to a chamber forming position in which they define the gas guide chamber 50. In this regard, as seen in FIG. 1, the first chamber portion 50*a* includes a semi-cylindrical body portion having an axial extent greater than the length of any of the tubes supported on the tube support members 38,39,40 and an enlarged foot portion 50*a*′ having a radial extent greater than the radial extent of the semi-cylindrical body portion. As seen in FIG. 1, the enlarged foot portion 50*a*′ radial extent sufficient to accommodate the base plate 42 and the top plate 43 of a respective one of the tube support members 38,39,40 when the tube support member is positioned between the first chamber portion 50*a* and the second chamber portion 50*b* in the gas guide chamber 50.

The second chamber portion 50*b* includes a semi-cylindrical body portion and, as shown in FIG. 1, an enlarged foot portion 50*b*′ having a radial extent greater than the radial extent of the semi-cylindrical portion. The radial extent of the enlarged foot portion 50*b*′ is sufficient to accommodate the base plate 42 and the top plate 43 of a respective one of the tube support members 38,39,40 when the respective tube support member is positioned in the gas guide chamber 50.

Figure 2:
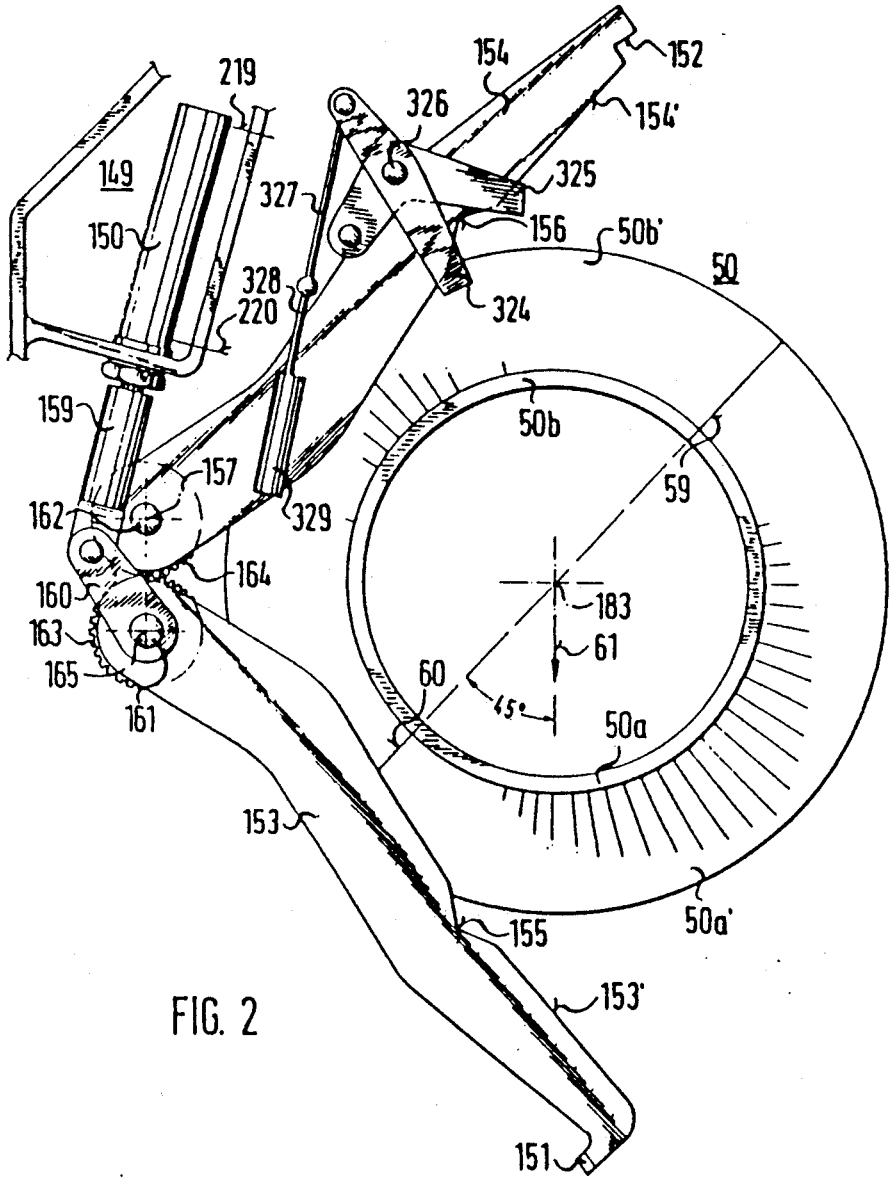
FIG. 2 is a top plan view of a gas guide chamber of the textile winding machine shown in Figure and showing a yarn shearing assembly thereof in open position.

The first chamber portion 50*a* and the second chamber portion 50*b* are compatibly configured with their respective semi-cylindrical body portions having the same radius and their respective enlarged foot portions 50*a*′ and 50*b*′ having the same cross sectional radial extent, such that the semi-cylindrical body portions and the enlarged foot portions, respectively, mate with one another along a first interface line 59 and a second interface line 60, as seen in FIG. 2, when the first chamber portion 50*a* and the second chamber portion 50*b* are moved into the chamber forming position to form the gas guide chamber 50. As seen in FIG. 1, the free end of the connector 62 is fixedly connected to the semi-cylindrical body portion of the first chamber portion 50*a* and the connector 63 is fixedly connected to the semi-cylindrical body portion of the second chamber portion 50*b* such that the semi-cylindrical body portions are supported in a vertical disposition. Thus, the gas guide chamber 50 includes a cylindrical portion, formed by the semi-cylindrical portions of the chamber portions 50*a*,50*b*, having an axis 183 (FIG. 2). As seen in FIG. 2, the first chamber portion 50*a* and the second chamber portion 50*b* are oriented relative to one another such that the first interface line 59 and the second interface line 60 define a line which intersects the direction of travel 61 at a 45 degree angle.

The winding station 2 includes a conventional yarn end receiving element having a suction tube 24 for applying a suction force through a suction intake mouth 25. The suction tube 24 is movable to move the suction intake mouth 25 along a circular arc 26. The yarn end receiving element is operable to receive a yarn end loosened from a yarn package at the unwinding location to convey the yarn end to a conventional splicing mechanism (not shown) for splicing with a yarn end of a yarn wound on a cross wound package (not shown) at the unwinding device 2 or for delivery to a yarn delivery component such as the splicing device 22 of the unwinding machine 2.

The yarn end loosening apparatus 31 operates as follows to loosen a yarn end of a yarn package supported on one of the tube support members 38,39,40 and to support the yarn package during subsequent unwinding of the yarn from the yarn package at the winding station 2. The tube support members 38,39,40, each supporting a tube having a yarn package built thereon such as, for example, the yarn packages 36,37 supported on the tube support members 39,40, respectively, are delivered by the delivery assembly 68 to the preliminary location for feeding to the unwinding device 2. In conventional manner, the tube support members 38,39,40 are loaded onto the endless belt of the cross-transport assembly 32 such that they are transported in the direction of travel 61 while arranged serially with respect to each other, as seen in FIG. 1.

As the tube support members 38,39,40 travel in the direction of travel 61 toward the unwinding location, the second chamber portion 50*b* is initially disposed in a clearance position in which it is sufficiently spaced from the cross path to permit the tube support members to be moved therepast by the cross-transport assembly 32. The second chamber portion 50*b* is disposed in its clearance position by appropriate control of the second movement means 65 by the central control unit 73. Specifically, the central control unit 73 controls the second movement means 65 to cause it to be charged with a conventional hydraulic fluid from a conventional hydraulic fluid source (not shown). The charging of the second movement means 65 with hydraulic fluid causes the connector 63 to be retracted into the second movement means 65, thereby displacing the second chamber portion 50*b* laterally toward the same side of the cross-transport assembly 70 as the side on which the second support post 67 is disposed to an extent sufficient for the cylindrical body portion and the enlarged foot portion 50*b*′ to be clear of the cross path.

The first chamber portion 50*a* is initially disposed in the chamber forming position whereby it intersects the cross path. As seen in FIG. 2, the semi-cylindrical body portion and the enlarged foot portion 50*a'* of the first chamber portion 50*a* face in the direction opposite to the direction of travel 61.

The cross-transport assembly 32 eventually moves the forward- most tube support member 38, as viewed in the direction of travel 61, past the second chamber portion 50*b*, which is disposed in its clearance position, and, further, into contact with the inner surface of the first chamber portion 50*a*. The base cylindrical plate 42 of the tube support member 38 contacts the enlarged foot portion 50*a'*, whereby further travel of the tube support member 38 in the direction of travel 61 is prevented. The tube support member 39, which is the next tube support member following the tube support member 38, has its base cylindrical plate 42 in contact with the base cylindrical plate 42 of the preceding tube support member 38 due to the continuous action of the endless belt of the cross-transport assembly 32.

The central control unit 73 then controls the second movement means 65 to extend the connector 63 to thereby effect movement of the second chamber portion 50*b* from its clearance position to the chamber forming position in which the second chamber portion 50*b* and the first chamber portion mate along the first engagement line 59 and second engagement line 60 with the yarn package supported on the tube support member 38 supported in upright disposition therebetween. The enlarged foot portion 50*b'* of the second chamber portion 50*b* displaces the tube support members 39 and 40 slightly in the direction opposite to the direction of travel 61 during the movement of the second chamber portion 50*b* from its clearance position to the chamber forming position. Accordingly, once the second chamber portion 50*b* is disposed in the chamber forming position, the enlarged foot portion 50*b'* extends between the respective cylindrical base plates 42 of the tube support member 38 and the tube support member 39 to thereby space the two tube support members from one another.

The gas guide chamber 50 formed by the first chamber portion 50*a* and the second chamber portion 50*b* provides a substantially sealed enclosure along the extent of the yarn package supported on the tube support member 38. Accordingly, once the second portion chamber 50*b* mates with the first chamber portion 50*a* to form the gas guide chamber 50, the central control unit 73 can control the regulating valve 57 to supply compressed gas to the jet nozzles 51,52 and 53. As seen in FIG. 1, the jet nozzles are oriented to direct jet streams of gas in inclined tangential directions with respect to the yarn package to loosen a yarn end of the yarn package.

The loosened yarn end is directed upwardly under the influence of a helical gas flow which occurs due to the orientation of the jet nozzles 51,52,53 and the cylindrical shape formed by the semi-cylindrical body portions of the first chamber portion 50*a* and the second chamber portion 50*b*. The helical flow of gas eventually lifts the loosened yarn end toward the top of the gas guide chamber 50 for engagement of the yarn end by the suction mouth of the suction device 24. Once the suction device 24 has grasped the loosened yarn end, the suction device 24 signals the central control unit 73 in conventional manner and the central control unit 73 controls the regulating valve 57 to cease the flow of compressed gas from the compressed gas source 58 to the jet nozzles 51,52,53. The central control unit 73 also controls the suction device 24 to swing the suction mouth 25 along the circular arc 26 to deliver the engaged yarn end to the splicing device for subsequent continued unwinding of the yarn from the yarn package disposed within the gas guide chamber 50.

Once the yarn on the yarn package supported on the tube support member 38 has been completely unwound, only an empty tube remains on the tube support member 38. In correspondence with the completion of the unwinding of the yarn package, the central control unit 73 controls the first movement means 64 to retract the connector 62 to thereby move the first chamber portion 50*a* from the chamber forming position to a clearance position in which the first chamber portion is cleared from the cross path sufficiently for the tube support member 38 to be conveyed therepast by the cross-transport assembly 32 toward the discharge location. Additionally, the central control unit 73 controls the second movement means 65 to retract the second chamber portion 50*b* from the chamber forming position to its respective clearing position.

Once the second chamber portion 50*b* reaches its respective clearance position, the next following tube support member 39 is moved by the action of the cross-transport assembly 32 in the direction of travel 61 into the unwinding location. In coordination with the movement of the tube support member 39 into the unwinding location, the central control unit 73 controls the first movement means 64 to move the first chamber portion 50*a* from its respective clearance position to a travel blocking position in which the enlarged foot portion 50*a'* sufficiently extends into the cross path at the unwinding location to prevent further travel of the tube support member 39 in the direction of travel 61.

The movement of the first chamber portion 50*a* from its respective clearance position to the travel blocking position is timed in coordination with the movement of the support member 38, which has just exited the unwinding location, such that the tube support member 38 has traveled sufficiently beyond the first chamber portion 50*a* to preclude the movement of the first chamber portion from its clearance position to the travel blocking position from hindering the movement of the tube support member 38 toward the discharge location. Depending upon the operating circumstances, the travel blocking position of the first chamber portion 50*a* may be substantially coincidental with its chamber forming position. In other operating circumstances, the travel blocking position may entail the positioning of the enlarged foot portion 50*a'* only slightly into the cross path but to a sufficient extent to prevent further travel of the next following tube support member 39. Thereafter, the first chamber portion 50*a* is moved to the chamber forming position.

Once the next following tube support member 39 is positioned at the unwinding location in contact with the first chamber portion 50*a*, the central control unit 73 controls the second movement means 65 to move the second chamber portion 50*b* from its respective clearance position to the chamber forming position. During this movement, the second chamber portion 50*b* contacts the tube support member 40, which is now the next following tube support member with respect to the tube support member 39 at the unwinding location, and displaces the tube support member 40 in a direction opposite to the direction of travel 61 as the second chamber portion moves into the chamber forming position. The enlarged foot portion 50*b'* is now interposed between the respective cylindrical base plates 42 of the tube support members 39,40. In correspondence with the movement of the second chamber portion 50*b* into the chamber forming position, the central control unit 73 controls the regulating valve 57 to supply compressed gas to the jet nozzles 51,52,53 to perform a yarn end loosening operation on the yarn package supported by the tube support member 39.

In FIGS. 15–18, an alternate embodiment of the yarn end loosening apparatus is illustrated. The alternate yarn end loosening apparatus 31 includes, in lieu of the jet nozzles 51,52 and 53, a lower pair of jet nozzles 330,331, an intermediate pair of jet nozzles 332,333 and an upper pair of jet nozzles 334,335, the respective pairs of jet nozzles each having a predetermined orientation with respect to a horizontal plane 336,337 and 338, respectively. The longitudinal gas conduits 343,344 are selectively communicated with a gas supply conduit 340 by a reversing valve assembly 339, as seen in FIG. 15. The gas supply conduit 340 is communicated with a conventional compressed gas source such as, for example, the compressed gas source 58 illustrated in FIG. 1. The reversing valve assembly 33 includes a slide member 348 and a coupling block 350.

As seen in FIG. 15, each respective pair of jet nozzles forms an angle alpha relative to its respective horizontal plane 336,337 or 338. The angle alpha which the intermediate pair of jet nozzles 332,333 form relative to their respective horizontal plane 337 is greater than the angle which the lower pair of jet nozzles 330,331 form relative to their respective horizontal plane 336. Additionally, the angle formed by the upper pair of jet nozzles 334,335 relative to their respective horizontal plane 338 is greater than the respective angles formed by the intermediate pair of jet nozzles 332,333 and the lower pair of jet nozzles 330,331. As seen in FIG. 16, the individual jet nozzles of each respective pair of nozzles such as, for example, the jet nozzles 334 and 335, direct streams of gas at different tangential directions relative to one another.

The jet nozzles 330–335 are mounted to the second chamber portion 50*b*. A gas conduit housing 342, as seen in FIG. 15, is mounted to the outer surface of the second chamber portion 50*b* and includes a pair of longitudinal gas conduits 343,344 (FIG. 16). The longitudinal conduit 343 is communicated with the respective jet nozzle of the three pairs of jet nozzles which direct a stream of gas in a common tangential direction. The longitudinal gas conduit 344 is connected to the other respective jet nozzle of the pairs of jet nozzles which direct streams of gas in the other tangential direction. The gas conduit housing 342 includes a top portion 345, as seen in FIG. 18 at which the mouths of the longitudinal gas conduits 343,344 are disposed. The top portion 345, as seen in FIG. 18, includes a pair of horizontal guide grooves 346,347. A slide member 348 includes a pair of horizontal flange members, each compatibly configured to engage a respective one of the guide grooves 346,347, to slidably mount the slide member 348 to the top portion 345 for sliding movement of the slide member in a horizontal direction. The slide member 348 additionally includes, as seen in FIG. 15, a throughbore 349.

The gas supply conduit 340 is connected via the coupling block 350 to the throughbore 349 of the slide member 348. As seen in FIG. 18, a conventional means for sliding the slide member 348 relative to the gas conduit housing 342 such as, for example, a conventional electromagnetic drive 361, is operatively connected to the central control unit 73. The central control unit 73 controls the electromagnetic drive 361 to selectively slide the slide member 348 relative to the longitudinal gas conduit housing 342 to selectively communicate the gas supply conduit 340 with a respective one of the longitudinal gas conduits 343,344. Specifically, as seen in FIG. 18, the electromagnetic drive 361 is operable to align the gas supply conduit 340 with the longitudinal gas conduit 344 whereby gas supplied through the gas supply conduit 340 is conducted by the longitudinal gas supply conduit 344 to the respective one jet nozzle of each pair of jet nozzles which directs streams of gas in a common tangential direction. Alternatively, the electromagnetic drive 361 can be controlled to move the slide member 348 relative to the longitudinal gas conduit housing 342 to bring the gas supply conduit 340 into communication with the longitudinal gas bore 343 for supplying gas to the other nozzles to direct the gas in the opposite tangential directions.

In FIGS. 16 and 17, one configuration of the system for supplying gas from the conventional compressed gas source through the gas supply conduit 340 to the reversing valve 339 is illustrated. FIG. 17 shows a vertical section of the system as viewed from the side of the chamber portion 50*b* with the figure of the drawing being disposed vertically. In this system a second cylindrical tube member 191 is provided with a vertically extending conduit 351 communicated at one end with a conventional compressed gas source. As seen in FIGS. 16 and 17, a gas conduit arm 356 is movably coupled via a pair of snap rings 354,355 to the second cylindrical tube member 191 for pivoting about the axis of the cylindrical tube member. The gas conduit arm 356 includes an axial bore 359 which opens into an annular gap 358 formed between the snap rings 354 and 355. The vertical conduit 351 in the second cylindrical tube member 191 is communicated via an interconnecting conduit 357 with the annular gap 358. The interconnecting conduit 357 extends transversely across the second cylindrical tube member 191 for communicating the vertical shaft 351 with another gas conduit arm. However, in the embodiment illustrated in FIGS. 16 and 17, the other portion of the interconnecting conduit 357 is blocked by a plug 360. The other end of the conduit 359 of the gas conduit arm 356 communicates with the gas supply conduit 340. A pair of conventional annular seals 352,353 seal the gas conduit arm 356 with respect to the second cylindrical tube member 191 so that the annular gap 358 experiences relatively little leakage.

As can be understood, compressed gas supplied from the conventional compressed gas source is supplied via the vertical conduit 351, the interconnecting conduit 357, the annular gap 358 and the conduit 359 to the gas supply conduit 340 throughout the range of pivotal movement of the gas conduit arm 356 with respect to the second cylindrical tube member 191. Accordingly, compressed gas is reliably supplied through the gas supply conduit 340 to the longitudinal gas supply conduits 343,344 throughout the range of movement of the second chamber portion 50*b* between its chamber forming position and its clearance position.

Figure 3:
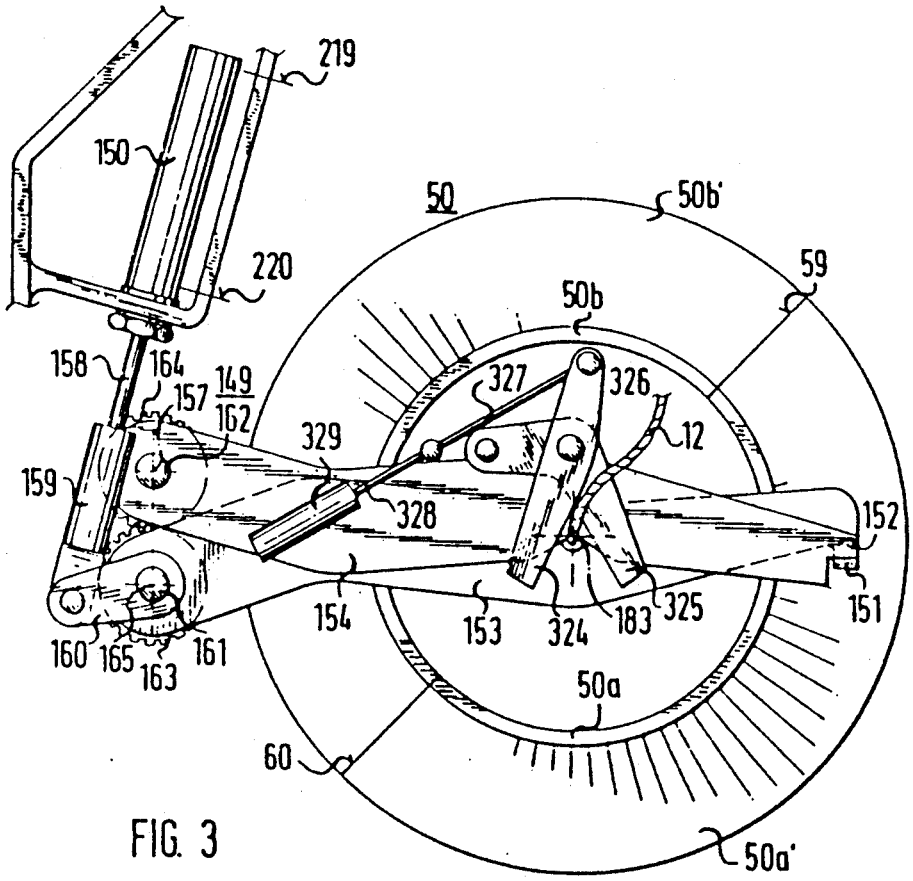
FIG. 3 is a view similar to FIG. 2 showing the yarn shearing assembly in closed position preparatory to shearing.

As seen in FIGS. 2 and 3 the yarn end loosening apparatus 31 additionally includes a yarn loop opening device 149 having a control device 150 and being mounted to the winding station 2 for engaging the yarn being unwound from a yarn package at the unwinding location as the yarn passes between the gas guide chamber 50 and the suction mouth 25 of the suction device 24. As seen in more detail in FIGS. 2 and 3, the yarn loop opening device 149 includes a first arm 153 and a second arm 154. One end portion of the first arm 153 includes a throughbore for receiving therethrough a vertical shaft 161 fixedly mounted to the support frame 5. The first arm 153 is supported on the vertical shaft 161 by conventional coupling means (not shown) which permit pivoting of the first arm 153 about the axis 165 of the vertical shaft 161. A gear 163 having a central throughbore is coaxially fixedly mounted to the first arm 153. Accordingly, the vertical shaft 161 extends through the respective throughbores of the gear 163 and the first arm 153 for vertical support thereof.

One end portion of the second arm 154 includes a throughbore for receiving therethrough a vertical shaft 162 which is fixedly connected to the support frame 5. A conventional coupling means (not shown) movably couples the second arm 154 to the shaft 162 for permitting pivoting of the second arm 154 about the axis 157 of the shaft 162. A gear 164 having a central throughbore is fixedly mounted to the second arm 154 with the central throughbore of the gear being coaxial with the axis 157 of the shaft 162 for vertical support thereon.

The first arm 153 includes a yarn engagement notch 155 and the second arm 154 includes a yarn engagement notch 156. The first arm 153 includes a contoured surface 153'. The second arm 154 includes a contoured surface 154'. The contoured surfaces 153',154' cooperate together to urge the yarn 12 toward a respective one of the notches 155,156 during the yarn engaging operation of the yarn loop opening device 149, as explained more fully below. As the yarn 12 contacts the first arm 153 and the second arm 154 during its travel therethrough, drag is imparted to the yarn which produces an increased yarn tension in the yarn downstream of the opening. The yarn engagement notches 155,156 are compatibly disposed on their respective arms such that the notches form an opening about the axis 183 of the gas guide chamber 50 for permitting the travel therethrough of yarn being unwound from a yarn package at the unwinding location such as, for example, a yarn 12, as seen in FIG. 3.

The first arm 153 and the second arm 154 extend parallel to one another in a horizontal direction and are vertically offset by a distance sufficient to preclude clamping of a yarn engaged therebetween, as discussed in more detail below. The respective gears 163,164 of the first arm 153 and the second arm 154 are disposed in the same horizontal plane with their teeth in meshing contact with one another for opposite synchronous movement of the arms.

The first arm 153 includes a vertically extending stop member 151 at its free end. The second arm 154 includes a recess 152 at its free end compatibly configured with the stop member 151 to receive the stop member therein when the first arm 153 and the second arm 154 are disposed in the yarn loop opening disposition shown in FIG. 3.

The control device 150 is fixedly mounted to the support frame 5 and to a conventional pneumatic servomotor having a piston rod 158 which is selectively extendable from, and retractable into, a cylinder. The control device 150 is operatively connected via a pair of electrical lines 219,220 to the central control unit 73. A connecting link 159 is fixedly mounted to the free end of the piston rod 158, and the free end of the connecting link 159 is pivotally mounted by a conventional pivot means to one end of a lever 160. The other end of the lever 160 includes a throughbore for receiving the shaft 161 therethrough and the end portion is fixedly connected to the first arm 153.

In operation, the first arm 153 and the second arm 154 are disposed in a non-engagement disposition, as shown in FIG. 2, in which the arms are pivoted away from one another. The pivoting of the arms away from one another occurs as follows. The central control unit 73 controls the control device 150 via the electrical lines 219,220, to retract the piston rod 158 into the cylinder of the pneumatic servomotor. As seen in FIG. 2, the retraction of the piston rod 158 correspondingly moves the connector link 159 in the direction toward the cylinder of the control device 150. The movement of the connector link 159 effects movement of the lever 160 in a clockwise direction. Since the lever 160 is fixedly connected to the first arm 153, the first arm 153 correspondingly rotates about the axis 165 and the gear 163 drives the gear 164 to effect pivoting of the second arm 154 about the axis 157 of the vertical shaft 162 in a direction opposite to the direction of rotation of the first arm 153 about the axis 165.

In its non-engagement disposition as shown in FIG. 2, the yarn loop opening device 149 permits access through the top of the gas guide chamber 50 for a yarn end to exit the gas guide chamber 50 for engagement by the suction mouth 25 of the suction device 24. Once the yarn end has been so engaged and the yarn end has been spliced onto a cross wound package, the central control unit 73 controls the control device 150 to move the first arm 153 and the second arm 154 into the yarn engagement disposition shown in FIG. 3 for preventing loops, curls or other yarn irregularities from traveling therebeyond during unwinding of the yarn 12 from the yarn package at the unwinding location. Such loops, curls and other such snarls may occur, for example, if the yarn tension is relatively weak.

The central control unit 73 controls the cylinder of the control device 150 to extend the piston rod 158 outwardly therefrom. The extending movement of the piston rod 158 effects, via the connector link 159, pivoting of the lever 160 in a counterclockwise direction about the axis 165 of the vertical shaft 161, as viewed in FIG. 3. The counterclockwise pivoting of the lever 160 effects counterclockwise pivoting of the first arm 153 and the gear 163 pivots in correspondence with the pivoting of the first arm 153 to drive the other gear 164 to effect pivoting of the second arm 154 about the axis 157 in a clockwise direction counter to the direction of rotation of the first arm 153. Accordingly, the first arm 153 and the second arm 154 pivot toward one another and, eventually, the yarn 12 is engaged by one of the surfaces 153' or 154' and directed toward the associated notch 155 or 156. The stop member 151 of the first arm 153 engages the recess 152 of the second arm 154 to limit pivoting of the first arm 153 and the second arm 154. The yarn 12 is accordingly disposed in the opening formed by the notches 155,156 upon completion of the pivoting of the first arm 153 and the second arm 154. The opening formed by the notches 155,156 is of sufficient extent to permit relatively unobstructed travel of the yarn 12 therethrough but of sufficiently limited extent to cause loops, curls and other types of snarls in the yarn 12 to be eliminated by contact with the first arm 153 and the second arm 154.

The yarn end loosening apparatus 31 additionally includes a yarn cutting assembly, as illustrated in FIGS. 2 and 3. The yarn cutting assembly includes a pivoted shearing arm 324, a fixed shearing arm 325 to which the pivoted shearing arm 324 is pivoted on a pivot post 326, a solenoid 329 fixedly mounted to the second arm 154, a rod 328 selectively extendable from, and retractable into, the solenoid 329 and a connecting link 327. The free end of the connecting link 327 is pivotally connected to one end of the pivoted shearing arm 324 and the other end of the connecting link 327 is connected to the free end of the rod 328. The solenoid 329 is operably controlled conventionally by the central control unit 73.

The pivoted shearing arm 324 and the fixed shearing arm 325 are disposed relative to the notch 156 such that the yarn cutting area defined therebetween is substantially coincidental with the opening defined by the notches 156,155. Accordingly, as shown in FIG. 3, the yarn cutting assembly is disposed in a disposition in which the yarn 12 traveling through the opening defined by the notches 155,156 travels through the cutting area between the pivoted shearing arm 324 and the fixed shearing arm 325. Accordingly, shearing of the yarn 12 is accomplished by retraction of the rod 328 into the solenoid 329 to effect pivoting of the pivoted shearing arm 324 on the pivot post 326 into yarn shearing engagement with the fixed shearing arm 325. The yarn shearing assembly can be activated, for example, to shear any trailing yarn following the completion of a winding operation. Alternatively, the yarn shearing assembly can be activated to prepare a yarn end for disposition on the yarn supply package in a preferred disposition such as, for example, in an upper winding or inserted into the upper open end of the tube of the package.

Figure 4:
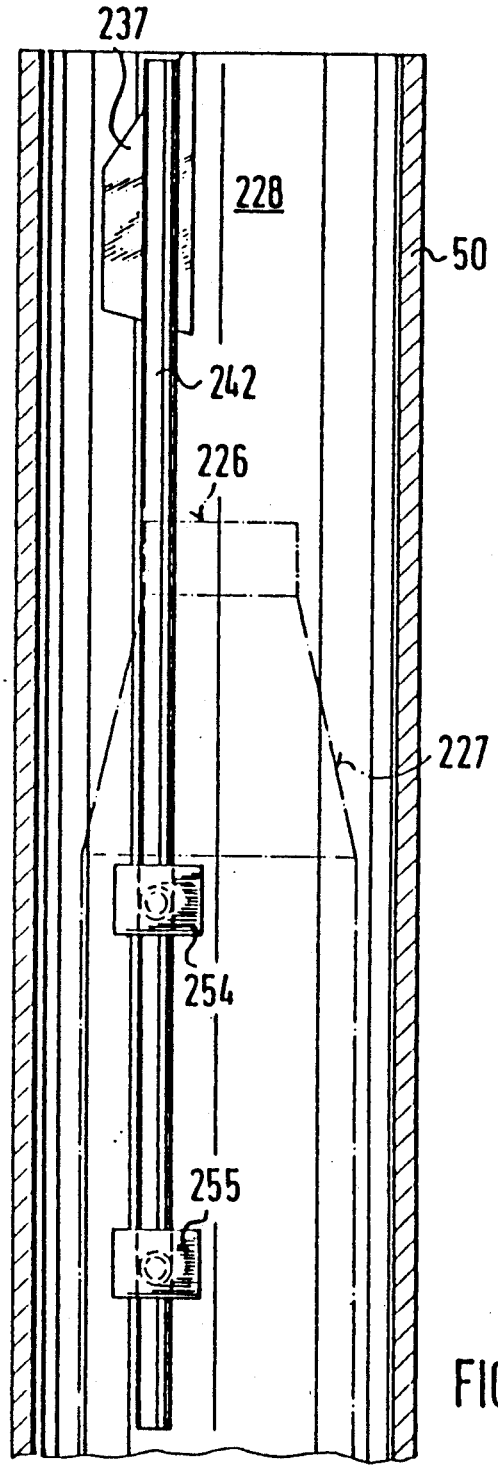
FIG. 4 is a vertical section of a portion of the one embodiment of the yarn unwinding guide apparatus shown in FIG. 1.
Figure 8:
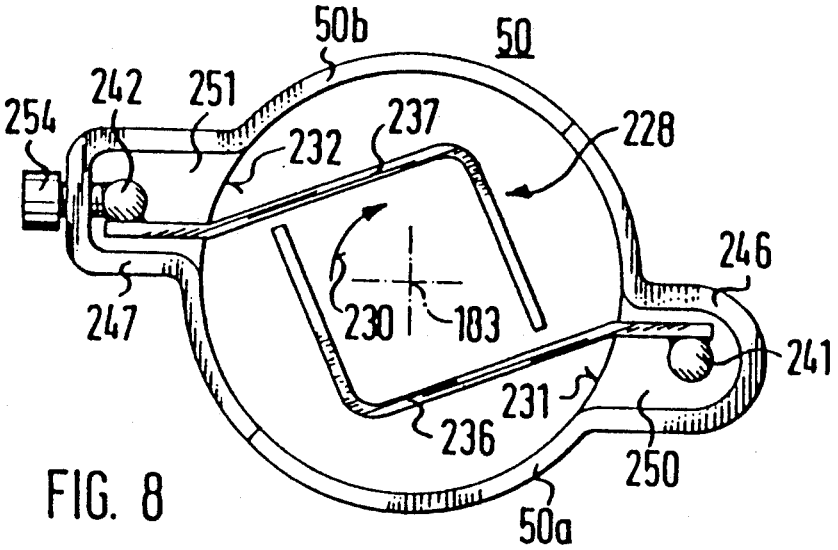
FIG. 8 is a top plan view of the embodiment of the yarn unwinding guide apparatus shown in FIG. 1.
Figure 7:
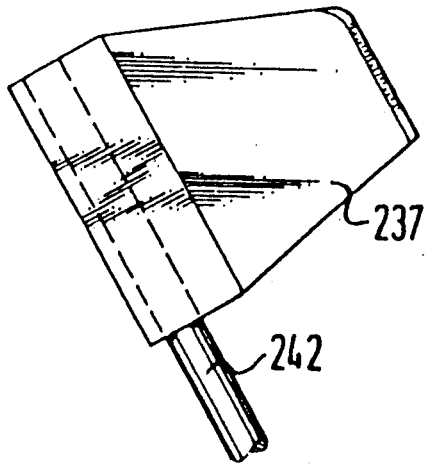
FIG. 7 is a perspective view of one arm plate of the embodiment of the yarn unwinding guide apparatus shown in FIG. 1.

In FIGS. 4, 7 and 8, the apparatus for handling yarn during axial unwinding of the yarn from a yarn package in the gas guide chamber 50 is illustrated. The yarn handling apparatus 228 includes means mounted to at least one of the chamber portions **50*a*,50*b* for restricting laterally outward displacement of the yarn relative to the axis 183 for restricting laterally outward displacement of the yarn relative to the axis 183 for restricting laterally outward displacement of the yarn relative to the axis of unwinding at a location between one end of the tube and generally at the top of the gas guide chamber 50. One embodiment, for example, as seen in FIG. 8, of the yarn unwinding guide apparatus 228 includes vertically extending plate means such as a first vertical plate 236 fixedly connected at one end to a vertical shaft 241 and a second vertical plate 237 fixedly connected at one end to a vertical shaft 242. As seen in FIG. 7, the upper and lower edges of each plate converge from the respective vertical shaft 241, 242** toward the free end of the plate.

As seen in FIG. 8, the vertical shaft 241 is disposed in a first offset 246 integrally formed on the first chamber portion **50*a* and defines a first recess 250 extending from the top of the first chamber portion 50*a* downwardly along a predetermined axial extent thereof. The first recess 250 communicates with the interior of the semi-cylindrical first chamber portion 50*a* through a longitudinally extending slot 231**.

The vertical shaft 242 is disposed in a second offset 247 integrally formed on the second chamber portion **50*b* and defines a second recess 251 extending from the top of the second chamber 50*b* along a predetermined axial extent thereof. The second recess 251 communicates with the interior of the semi-cylindrical second chamber portion 50*b* through a longitudinal slot 232**.

As seen in FIG. 4, each vertical shaft 241, 242 such as, for example, the vertical shaft 242, is secured to the respective first chamber portion **50*a* or the second chamber portion 50*b* vertically below the bottom of the respective longitudinal slot 231, 232 by a pair of spaced conventional adjustable fastening devices 254 and 255. The adjustable fastening means 254, 255 include appropriate conventional releasable tightening means such as, for example, adjusting screws, for permitting selective axial adjustment of the vertical shafts 241, 242 relative to the gas guide chamber 50**.

As seen in FIG. 8, the first vertical plate 236 extends interiorly of the gas guide chamber 50 through the longitudinal slot 231 and is formed with a generally right angled bend. The second vertical plate 237 extends interiorly into the gas guide chamber 50 through the longitudinal slot 232 and is formed with a generally right angled bend. The first vertical plate 236 and the second vertical plate 237 are compatibly configured with one another to form a yarn receiving area within the lateral extent of the gas guide chamber 50 for confining the path of the yarn being unwound. The yarn receiving area is generally centered on the axis 183 of the gas guide chamber 50. As seen in FIG. 4, the bottom edges of the vertical plates 236 and 237 are selectively adjustably positionable relative to the top surface of the tube of the yarn package disposed in the gas guide chamber 50 such as, for example, the top surface 226 of a yarn package 227. For example, the bottom edges of the plates 236 can be adjustably positioned at approximately two centimeters above the top surface 226.

In operation, the vertical plates 236 and 237 are moved into position for defining the yarn receiving area in conjunction with the disposition of the chamber portions **50*a* and 50*b* in their chamber forming position. In coordination with the unwinding of the yarn 12 from the yarn package disposed in the gas guide chamber 50, the yarn unwinding guide apparatus 228 engages the yarn 12 and directs the yarn into the yarn receiving area formed by the vertical plates 236 and 237 and thereafter maintains the yarn within the yarn receiving area throughout the subsequent unwinding of the yarn to thereby minimize undesirable ballooning of the yarn as it travels beyond the top of the tube. The plate means of the yarn unwinding guide apparatus 228 includes means for guiding the yarn from the inner wall of the gas guide chamber 50 into the yarn receiving area. Specifically, the outer ends of the vertical plates 236 and 237 are each spaced from the opposite plate to define two openings through which the yarn 12 can pass into the yarn receiving area. Thus, as the yarn is unwound in the direction indicated by the arrow 230 as seen in FIG. 8, and if it is initially outside the yarn receiving area if will contact one of the vertical plates 236 and 237** and be guided therealong to one of the openings through which it passes into the yarn receiving area.

Figure 6:
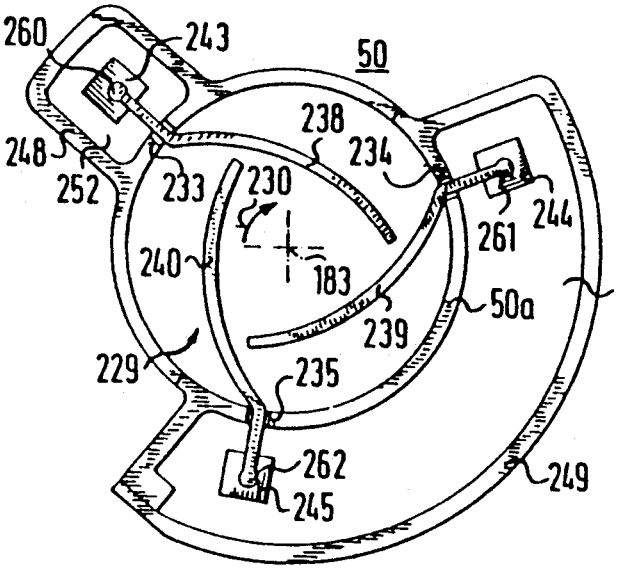
FIG. 6 is a top plan view of the another embodiment of the yarn unwinding guide apparatus shown in FIG. 5.
Figure 5:
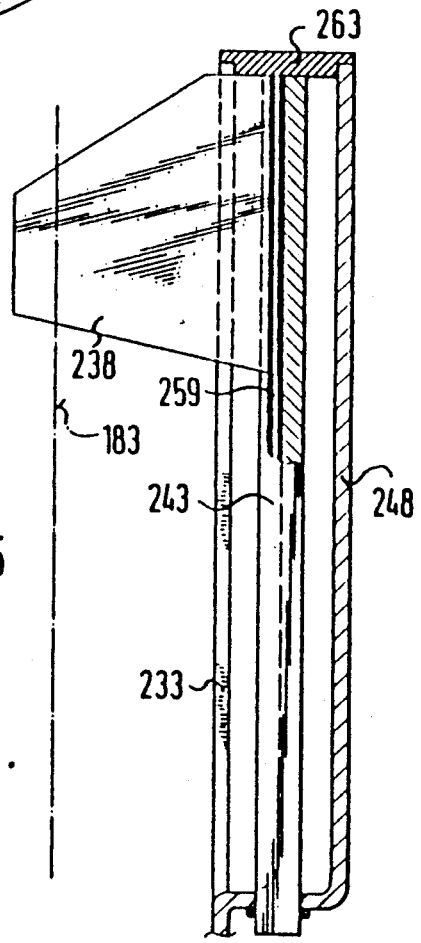
FIG. 5 is a side elevational view, in vertical section, of a portion of another embodiment of the yarn unwinding guide apparatus of the present invention.

In FIGS. 5 and 6, another embodiment of the yarn unwinding guide apparatus of the present invention is illustrated and is generally designated as 229. The yarn unwinding guide apparatus 229 includes a first vertical plate 238 having a vertical outer enlarged edge 260, and converging therefrom toward its inner end. The yarn unwinding guide apparatus 229 also includes a second vertical plate 239 having a vertical outer enlarged edge 261, and a third vertical plate 240 having a vertical outer enlarged edge 262. The second and third plates 239, 240 are formed with the same converging shape as the first plate 238.

As seen in FIG. 5, the enlarged out edge 260 of the first vertical plate 238 is slidably received in a longitudinal slot 259 formed in a vertical post 243 mounted in a first offset 248 integrally formed with the second chamber portion 50*b*. As seen in FIG. 5, the first offset 248 defines a longitudinally extending recess 252 extending downwardly from the top of the second chamber portion 50*b* to a predetermined extent. A cover member 263 covers the top of the recess 252, as seen in FIG. 5.

As seen in FIGS. 5 and 6, the first vertical plate 238 extends from the recess 252 through a longitudinal slot 233 interiorly into the gas guide chamber 50.

As seen in FIG. 6, vertical posts 244, 245 are disposed in a recess 253 defined by a second offset 249 which is integrally formed with the first chamber portion 50*a*. The top of the second pocket member 249 is covered by an appropriate cover member (not shown) similar to the cover member 263. The second vertical plate 239 has an extends from the recess 253 through a longitudinal slot 234 interiorly into the gas guide chamber 50. The third vertical plate 240 has an enlarged outer edge 262 slidably mounted in a slot in the post 245 and extends from the recess 253 through another longitudinal slot 235 interiorly into the gas guide chamber 50.

As seen in FIG. 6, the vertical plates 238, 239 and 240 are equally spaced circumferentially in the chamber 50 and are formed with facing arcuate surfaces to form a somewhat triangular yarn receiving area centered on the axis 183 of the gas guide chamber 50 for receiving traveling yarn therein to guide the yarn during the unwinding of a package in the gas guide chamber 50. Each of the plates 238–240 has an inner edge spaced from the other plates to provide openings to guide a traveling yarn being unwound in the direction indicated by the arrow 230 into the yarn receiving area for limiting the ballooning of the yarn during its passage from the top of the tube to the yarn feeding component of the winding station 2.

Each of the plates 238–240 is conventionally longitudinally adjustable along a longitudinal slot formed in the respective post 243, 244 or 245 which supports the plate. For example, the first plate 238 is longitudinally adjustable along the longitudinal slot 259 of the shaft 243 with the enlarged edge 260 of the plate preventing lateral removal of the first plate from the shaft 243. The present invention additionally contemplates that the vertical posts 243, 244 and 245 can be integrally constructed with the first chamber portion 50*a* and the second chamber portion 50*b*.

Figure 9:
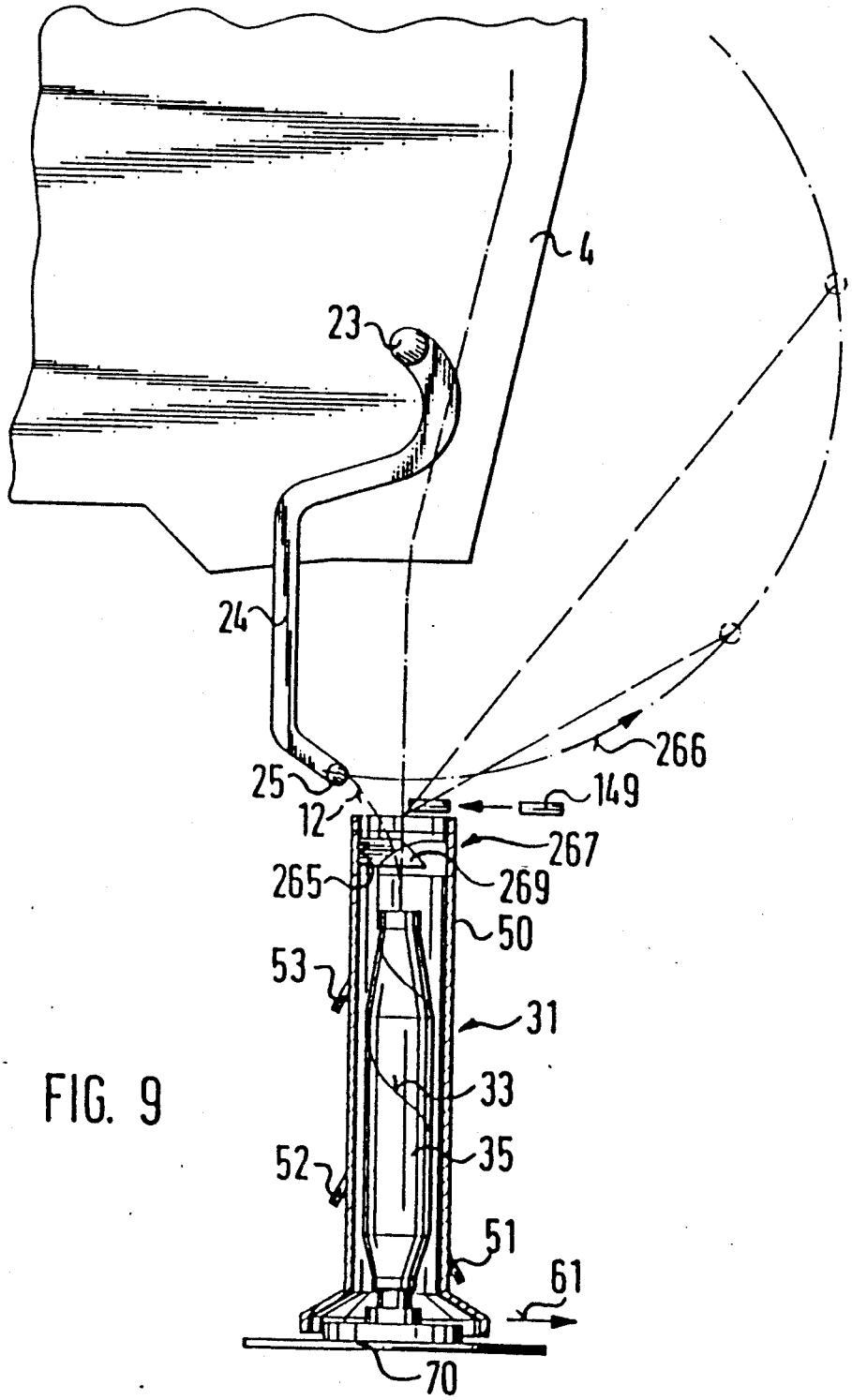
FIG. 9 is a side elevational view, partially in section, of an additional embodiment of the yarn unwinding guide apparatus of the present invention.
Figure 10:
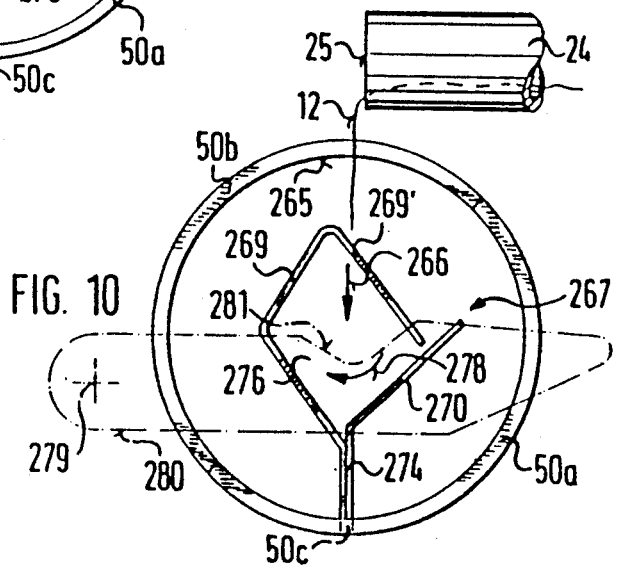
FIG. 10 is a top plan view of the embodiment of the yarn unwinding guide apparatus shown in FIG. 9.
Figure 11:
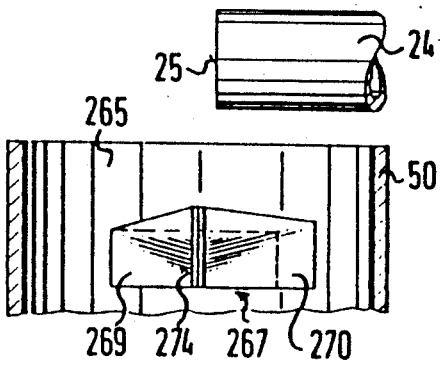
FIG. 11 is a vertical sectional view of a portion of the yarn unwinding guide apparatus shown in FIG. 9.

In FIGS. 9, 10 and 11, an additional embodiment of the yarn unwinding guide apparatus of the present invention is illustrated and is generally designated as 267. The yarn unwinding guide apparatus 267 includes guide means 274 having a first contoured member 269 forming three sides of a four sided yarn receiving area and a second contoured member 270 forming the other side of the yarn receiving area. The first contoured member 269 and the second contoured member 270 each include a linear free end portion and the linear free end portions are disposed in parallel contact with one another and are axially movably coupled to the first chamber portion 50*a* in a longitudinal slot 50*c*. The linear free end portion of the second contoured member 270 extends laterally outwardly from the first contoured member. The free end portion 269' of the first contoured member 269 forms a longitudinal entry gap with the second contoured member 270 for entry of a traveling yarn being unwound from a package in the gas guide chamber 50 into the yarn receiving area 276 defined between the first contoured member 269 and the second contoured member 270.

A conventional yarn loop opening device 280, schematically shown in FIG. 10 in broken lines, is pivotable about a pivot 279 in a horizontal plane between the top of the gas guide chamber 50 and the suction mouth 25 of the suction tube 24. The yarn loop opening device 280 includes a notched surface 281 for engaging the yarn 12 traveling between the gas guide chamber 50, past the horizontal plane in which the yarn loop opening device 280 pivots and into the suction mouth 25 of the suction tube 24.

In operation, when a yarn end such as, for example, a reserve winding 33 or an upper winding on the yarn package within the gas guide chamber 50 is loosened and propelled upwardly out of the gas guide chamber, the yarn unwinding guide apparatus 267 engages the yarn moves the yarn in a lateral direction 266 to direct the yarn into the yarn receiving area defined between the first contoured member 269 and the second contoured member 270. Specifically, as the yarn 12 unwinds in the direction indicated by the arrow 278 in FIG. 10, the yarn is guided by the free end portion 269' of the first contoured member 269. The second contoured member 270 then guides the yarn through the longitudinal entry gap defined therebetween.

The orientation of the first contoured member 269 relative to the second contoured member 270 insures that the yarn 12 continues to travel within the yarn receiving area as it unwinds in the direction 270 without the risk that the yarn 12 will exit the yarn receiving area 276 through the longitudinal entry gap. As the yarn 12 initially exits the gas guide chamber 50 it moves relatively along the inner surface 265 of the second chamber portion 50*b* in the direction of rotation 278. The suction action applied by the suction tube 24 through the suction mouth 25 thereafter draws the yarn 12 upwardly into the suction tube and the suction tube is then controlled to move the suction mouth 25 in the direction indicated by the arrow 266 in FIG. 10 generally across the axis of the gas guide chamber 50.

During the movement of the suction mouth 25 in the direction 266, the traveling yarn 12 engages the outer surface of the free end portion 269' and is guided therealong into contact with the second contoured portion 270. In this regard, the second contoured member 270 extends beyond the free end portion 269' to insure that the yarn 12 is engaged by the second contoured member as it passes beyond the free end portion 269'. Thereafter, the yarn 12 moves along the inner surface of the second contoured member 270 through the longitudinal entry gap into the yarn receiving area 276.

The operation of the yarn loop opening device 280 and the first contoured member 269 cooperate together to control the elimination of yarn loops or other types of snarls during the unwinding operation. Specifically, the free end portion 269' of the first contoured member 269 is connected to an intermediate portion of the first contoured member and forms an angle less than 180° therewith. The angle formed by the intermediate portion and the free end portion 269' opens in a direction generally opposed to the direction in which the notched surface 281 of the yarn loop opening device 280 opens. Accordingly, pivoting of the yarn loop opening device 280 in a counterclockwise direction as seen in FIG. 10 acts to continuously restrict the radial movement of the traveling yarn 12 relative to the axis of the gas guide chamber 50. Specifically, the traveling yarn 12 is constrained in one radial direction by the intermediate portion of the free end portion 269' of the first contoured member 269 and in the other radial direction by the notched surface 281 of the yarn loop opening device 280. Accordingly, the control of yarn loops and other snarls in the traveling yarn 12 can be controlled through selective pivoting of the yarn loop opening device 280.

As seen in FIG. 11, the parallel, linear end portions of the first contoured member 269 and the second contoured member 270 have a greater axial extent than the free end portions of each contoured member. Accordingly, each contoured member 269, 270 converges slightly from its linear end portion toward its free end portion.

In FIG. 12, another additional embodiment of the yarn unwinding guide apparatus of the present invention as illustrated and is generally designated as 268. The yarn unwinding guide apparatus 268 includes a fork having two tines. The tine comprises a finger member 273 fixedly attached to the second chamber portion **50*b* and the second tine comprises a fork member 275 attached to the first chamber portion 50*a*. The fork member 275 includes a pair of diverging portions 271 and 272, each having a linear end section. The linear end sections are parallel and in contact with one another and are slidably received for longitudinal movement in a longitudinal slot 50*c* formed in the first chamber portion 50*a*. The finger member 273 cooperates with the diverging portions 271, 272 to form vertical openings shaped as longitudinal gaps therebetween for passage of a traveling yarn 12 from a gas guide chamber space 282 into a yarn receiving area defined by the finger member 273 and the fork member 275**.'

In operation, the yarn 12 is drawn into the suction mouth 25 by the suction action operating in the suction tube 24, as the yarn 12 exits the top of the gas guide chamber 50. If the yarn 12 is traveling through the gas guide chamber area 282, the suction action applied by the suction tube 24 causes the yarn 12 to move along the outer surface of one of the diverging portions 271, 272 and through the gap defined therebetween into the yarn receiving area. If the yarn 12 is traveling in the gas guide chamber area 283, the suction tube 24 causes the yarn 12 to travel along the outer surface of the finger member 273, along the inner surface 265 of the gas guide chamber 50 or along the outer surface of the other diverging portion 272. If the yarn 12 travels along the outer surface of the finger member 273, it eventually is moved beyond the finger member and into contact with the inner surface of the diverging portion 272 and through the gap into the yarn receiving area. On the other hand, if the yarn 12 travels along the inner surface 265 of the chamber, it is eventually brought into contact with the outer surface of the diverging portion 272 and moves beyond the free end thereof. Once the suction tube 24 is controlled to move the suction mouth 25 in the direction indicated by the arrow 266 generally cross the axis of the gas guide chamber 50, the yarn 12, which has been engaged by the suction tube 24, is moved into contact with the outer surface of the finger member 273 and passes through the gap into the yarn receiving area. The configuration of the yarn unwinding guide apparatus 268 prevents the traveling yarn 12 from exiting the yarn receiving area through one of the longitudinal gaps so long as the yarn unwinds in the direction indicated by the arrow 278.

In FIGS. 19, 20, 21 and 22, a further embodiment of the yarn unwinding apparatus of the present invention is illustrated and includes plate means 380 having a continuous surface shaped to form a generally triangular yarn receiving area 382, and guide means including a first guide surface 383 and a second guide surface 384 extending from the yarn receiving area 382 and being slight spaced to define a longitudinal slot 387. The first guide surface 383 and the second guide surface 384 are configured to define an overall concave segment with the longitudinal slot 387 generally centered at the midpoint of the concave surface for guiding of a yarn by the guide surfaces 383 and 384 in the direction of the arrow 381 in FIG. 22 through the slot 387 into the yarn receiving area 382.

Figure 22:
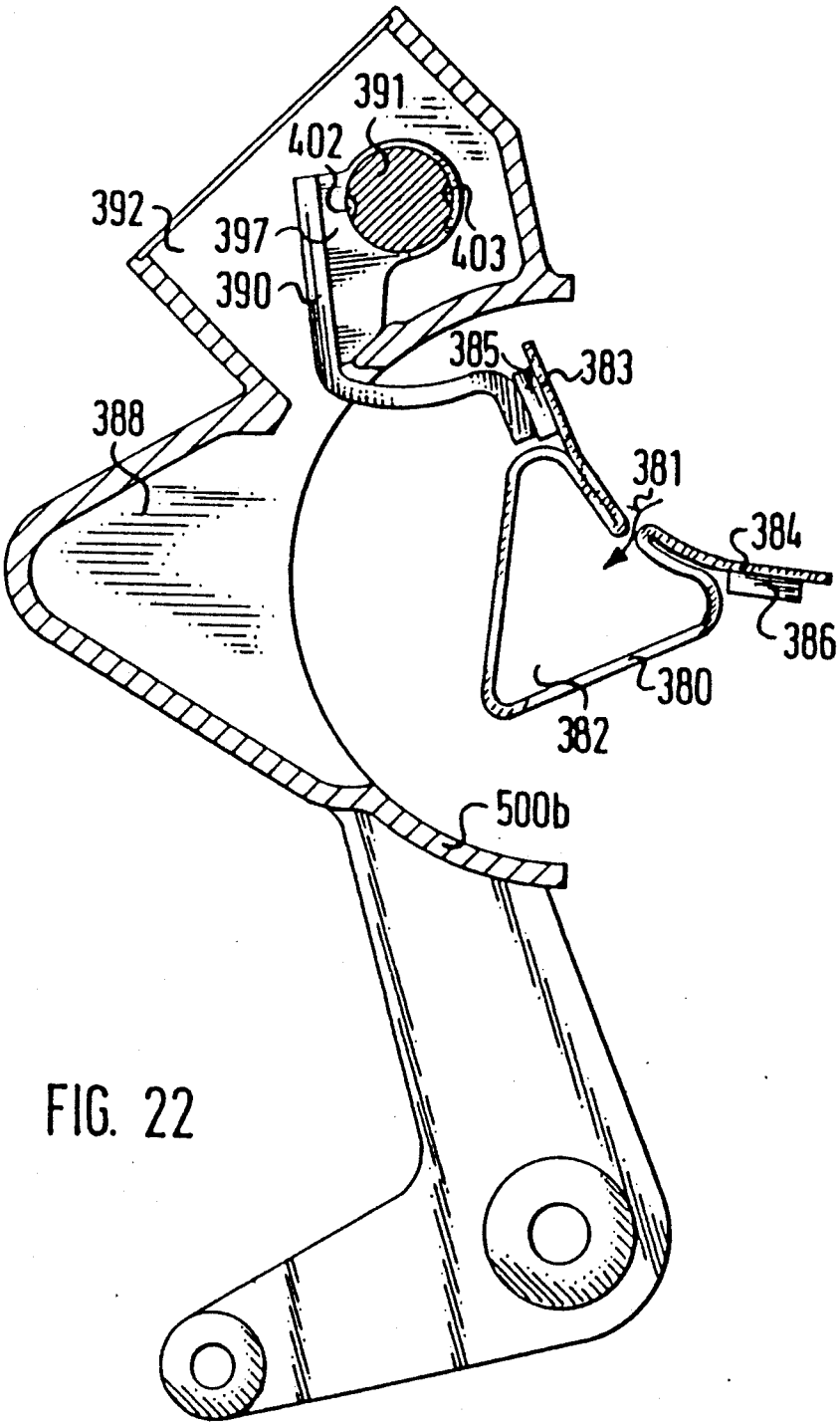
FIG. 22 is a horizonal sectional view of the yarn unwinding guide apparatus shown in FIGS. 19 and 20 in its yarn receiving condition.

The yarn unwinding guide apparatus also includes means for moving the plate means 380 laterally into an inoperative position out of yarn engagement. The moving means includes, as seen in FIG. 22, a first conventional fastener means 385 secures the first guide surface member 383 to a pivot arm 390, which is connected by a bracket 397 to a vertical shaft 391. The vertical shaft 391, the bracket 397 and a portion of the pivot arm 390 are disposed in an offset 392 integrally formed in the second chamber portion **500*b*, which forms the gas guide chamber 50** in cooperation with a first chamber portion (not shown).

The vertical shaft 391, which is cylindrical, extends through the enclosure formed by the offset 392 and is rotatably coupled to the top of the offset 392 by a conventional annular seal 404 and rotatably coupled to the bottom of the offset 392 by a conventional annular seal 393. The bottom of the vertical shaft 391 is operatively connected to a conventional drive motor 394 for selectively reversibly pivoting the vertical shaft 391 about its axis in the directions indicated by the arrow 395 in FIG. 19 through a range of total movement of approximately 30°.

Figure 19:
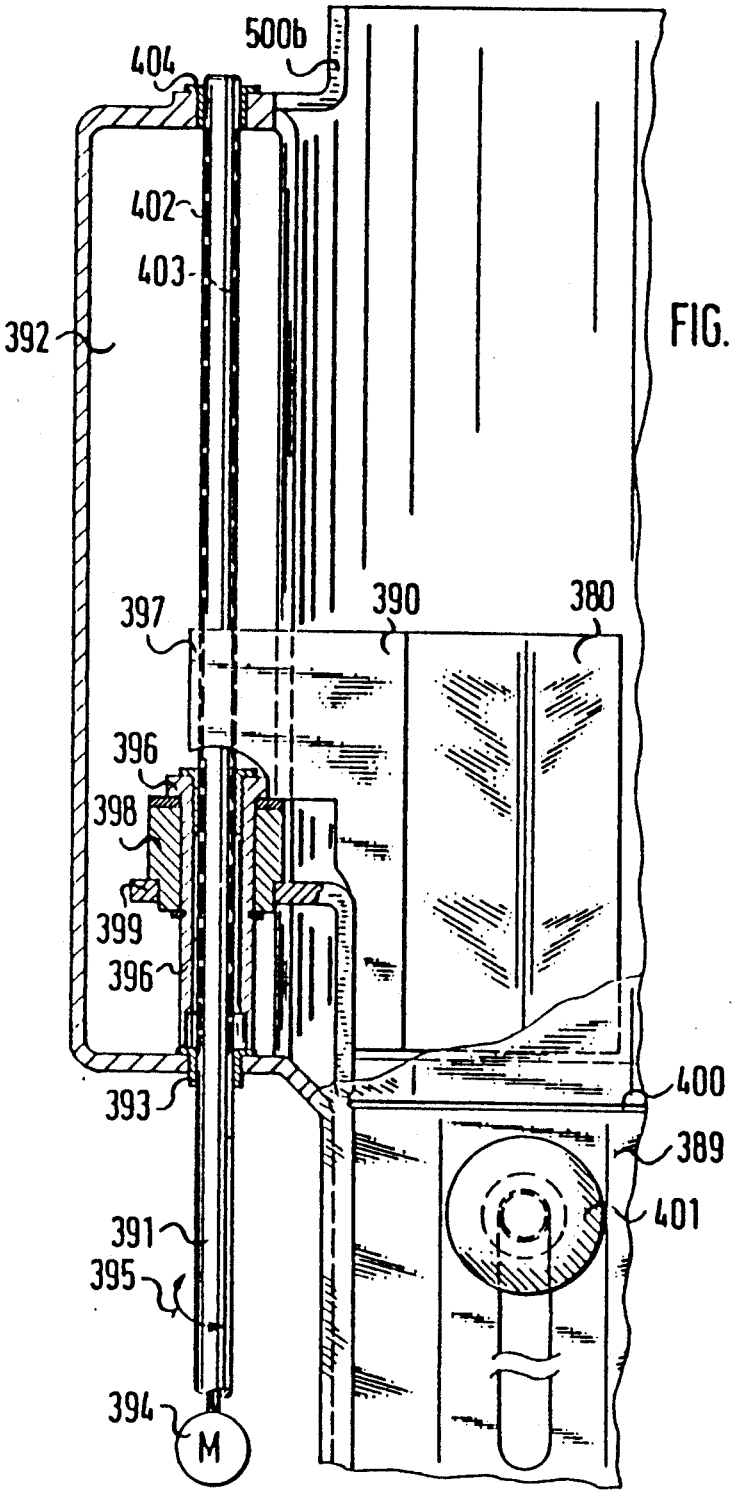
FIG. 19 is a vertical sectional view, of a further embodiment of the yarn unwinding guide apparatus of the present invention.

As seen in FIG. 22, the bracket 397 extends around the circumference of the vertical shaft 391 and includes diametrically opposed longitudinal projections, each projection being longitudinally slidably received in a respective longitudinal slot 402, 403 formed in the circumference of the vertical shaft 391. Accordingly, the bracket is retained for pivoting with the shaft but the vertical position of the bracket 397 relative to the vertical shaft 391 is adjustable by slidably moving the diametrically opposed projections along the longitudinal slots 402, 403. To position the vertical height of the bracket 397 relative to the vertical shaft 391 at any one of an infinite number of predetermined positions, a height adjustment assembly is provided which includes an annular sleeve 396 disposed about the circumference of the vertical shaft 391 for rotational and axial movement relative to the vertical shaft 391. The annular sleeve 396 includes a radially enlarged top annular shoulder which is engaged by an annular jacket member 398 disposed around the circumference of the annular sleeve 396. The annular jacket member 398 is rotatably supported on a carrier bracket 399, which is integrally formed with a slide plate 389 as seen in FIG. 19. The slide plate 389 is formed with an arcuate cross-sectional shape compatibly configured with the inner circumference of the second chamber portion **500*b* and the slide plate includes a threaded bore for threadably receiving an adjustment bolt 401. The adjustment bolt 401 extends through a longitudinal adjustment slot formed in the second chamber portion 500***b*. The slide plate 389 is longitudinally movable through a lateral arcuate slot 400 formed in the second chamber portion 500*b* into the interior of the offset 392.

In operation, the conventional drive motor 394, which is operatively connected conventionally to the central control unit 73, is operable to pivot the vertical shaft 391 to effect movement of the yarn receiving member 380 between a non-disposed position in which it is disposed in a recess 388 integrally formed in the second chamber portion 500*b*, as shown in FIG. 20, and a yarn engaging position, as shown in FIG. 22, in which the yarn receiving member 380 is generally centered with respect to the axis 183 of the gas guide chamber 50. The height of the yarn receiving member 380 relative to the top of the tube of the yarn package being unwound is selectively adjustable by movement of the slide plate 389 relative to the second chamber portion 500*b*. Specifically, the carrier bracket 399 moves in correspondence with the movement of the slide plate 389 and thereby moves the annular jacket members 398 and the annular sleeve 396. The vertical movement of the annular sleeve 396 effects guided vertical movement of the bracket 397 relatively along the longitudinal slots 402, 403 of the vertical shaft 391. Upon positioning of the yarn receiving member 380 at the predetermined height, the adjustment bolt 401 is appropriately threadably tightened within the bore of the slide plate 389 to removably fixably secure the slide plate 389 to the second chamber portion 500*b*. Thus, the height of the yarn receiving member 380 relative to the top of the tube of the yarn package can be adjusted to accommodate differences in the height of the yarn packages unwound in the gas guide chamber 50 and to accommodate differences in the unwinding speed of the yarns.

The second surface 384 may be connected to a second conventional fastening means 386 for alternatively fastening the yarn receiving member 380 to a pivot arm (not shown) for pivoting of the yarn receiving member 380 about a vertical axis different than the vertical axis of the vertical shaft 391.

The present invention additionally contemplates that the slide plate 398 can be configured to be movable independently of the movement of the yarn receiving member 380, whereupon the slide plate 398 could be independently moved to cover the open side of the offset 392 which communicates with the interior of the gas guide chamber 50.

In FIG. 21, a variation of the assembly for adjusting the height of the yarn receiving member 380 relative to the top of the tube is illustrated. A slide plate 389' is slidably received in a longitudinal recess formed between a movable chamber portion 500*c* and an outer wall member 405. The slide plate 389' includes a threaded bore 406 for threadably receiving the adjustment bolt 401, which is longitudinally movable along a longitudinal slot formed in the outer wall member 405 to adjustably position the slide plate 389' at a selected height.

In FIGS. 23 and 24, a yarn clamp assembly 407 is illustrated and is configured for installation into the suction tube 24, shown in FIG. 1, for clamping a length of yarn drawn by suction into the suction tube 24. As seen in FIG. 23, the suction tube 24 includes a downstream tube section 24' forming the suction mouth 25 at one end thereof, and an upstream tube section 24''. The downstream tube section 24' and the upstream section 24'' are communicated with one another by the yarn clamp assembly 407. As seen in FIG. 24, the yarn clamp assembly 407 includes a pair of connecting plates 410, 410' spaced from one another to receive the oppositely facing free ends of the downstream tube section 24' and the upstream tube section 24'' therein. The free end of each tube section received between the connecting plates 410, 410' are each formed with an arcuate concave surface of the same radius.

A ball valve member 408 having a truncated spherical shape, is rotatably supported between the connecting plates 410, 410' by a shaft 414 rotatably received in a throughbore 412 of the connecting plate 410 and a shaft 413 rotatably received in a throughbore 411 of the connecting plate 410'. The ball valve member 408 includes a throughbore 409 aligned with the shafts 414, 413 and the spherical surfaces of the ball valve member 408 have a radius slightly less than the radium of the arcuate concave surfaces of the downstream tube section 24' and the upstream tube section 24''. Accordingly, the ball valve member 408 forms an annular arcuate gap of a width S of approximately one millimeter with the tube section 24', 24''.

As seen in FIGS. 23 and 24, the ball valve member 408 is connected to an actuating means for effecting movement of the ball valve member 408 between a suction applying position and a stopping position. The actuating means includes an actuation lever 415 connected on the shaft 413. A pawl member 417 is disposed adjacent the yarn clamp assembly 407 for engagement with the actuation lever 415 in a manner described below. The pawl member 417 is mounted on the free end of a lever 418 which is fixedly mounted by a bolt 419 to the support frame 5. A pair of conventional springs 420, 420' resiliently bias the pawl member 417 into a neutral position, as shown in FIG. 23.

In operation, the actuation lever member 415 is disposed in the solid line position shown in FIG. 23, whereby the throughbore 409 of the ball valve member 408 is aligned to communicate with the tube sections 24' and 24''. Accordingly, when a suction action is applied through the tube sections 24', 24'' to engage a yarn end which has been propelled upwardly out of the gas guide chamber 50, the suction tube 24 is pivoted to move the suction mount 25 along the arcuate path 26 shown in FIG. 1. During this pivoting movement of the suction tube 24, the actuation lever 415 is brought into contact with the pawl member 417. During further pivoting of the suction tube 24, the pawl member 417 prevents further movement in the direction indicated by the arrow 416 in FIG. 23 while the suction tube is pivoting, thereby effecting movement of the actuation lever 415 to the blocking position shown in the broken line 415' in FIG. 23.

When the actuation lever 415 is in the blocking position, the throughbore 409 is in a position transverse to the direction of flow through the tube sections 24', 24'', as shown in FIG. 24, whereby the suction action through the suction mouth 25 is ceased. Additionally, during the movement of the actuation lever 415 from its solid line position in FIG. 23 to the blocking position shown by the broken lines 415', the yarn drawn into the downstream tube section 24' is clamped between the ball valve member 408 and the arcuate concave surface of the downstream tube section 24' at the position indicated as 421 in FIG. 24. This clamping action is facilitated by configuring the ball valve member 408 with a relatively low mass such as, for example, forming the ball valve member 408 from plastic material, whereby the ball valve member rises slightly under the suction action in the direction toward the upstream tube section 24''. This upward movement of the ball valve member 408 somewhat expands the width of the arcuate annular gap between the ball valve member and the arcuate concave surface of the downstream tube section 24' to thereby permit the yarn end to be suctioned between the ball valve member and the arcuate concave surface at the position 421. The clamping action of the ball valve member 408 and the downstream tube section 24' on the yarn end can be adjusted such that the yarn end is readily withdrawable from the suction tube 24 during a subsequent yarn splicing operation.

When the suction tube 24 is pivoted back to its initial position for receiving a yarn end, the actuation lever 415, which previously had moved beyond the pawl member 417, in the direction indicated by the arrow 416, during the pivoting of the suction tube 24 subsequent to the disposition of the actuation lever in its blocking position 415', again contacts the pawl member 417 and is thereby returned to its initial solid line position as shown in FIG. 23.

Figure 13:
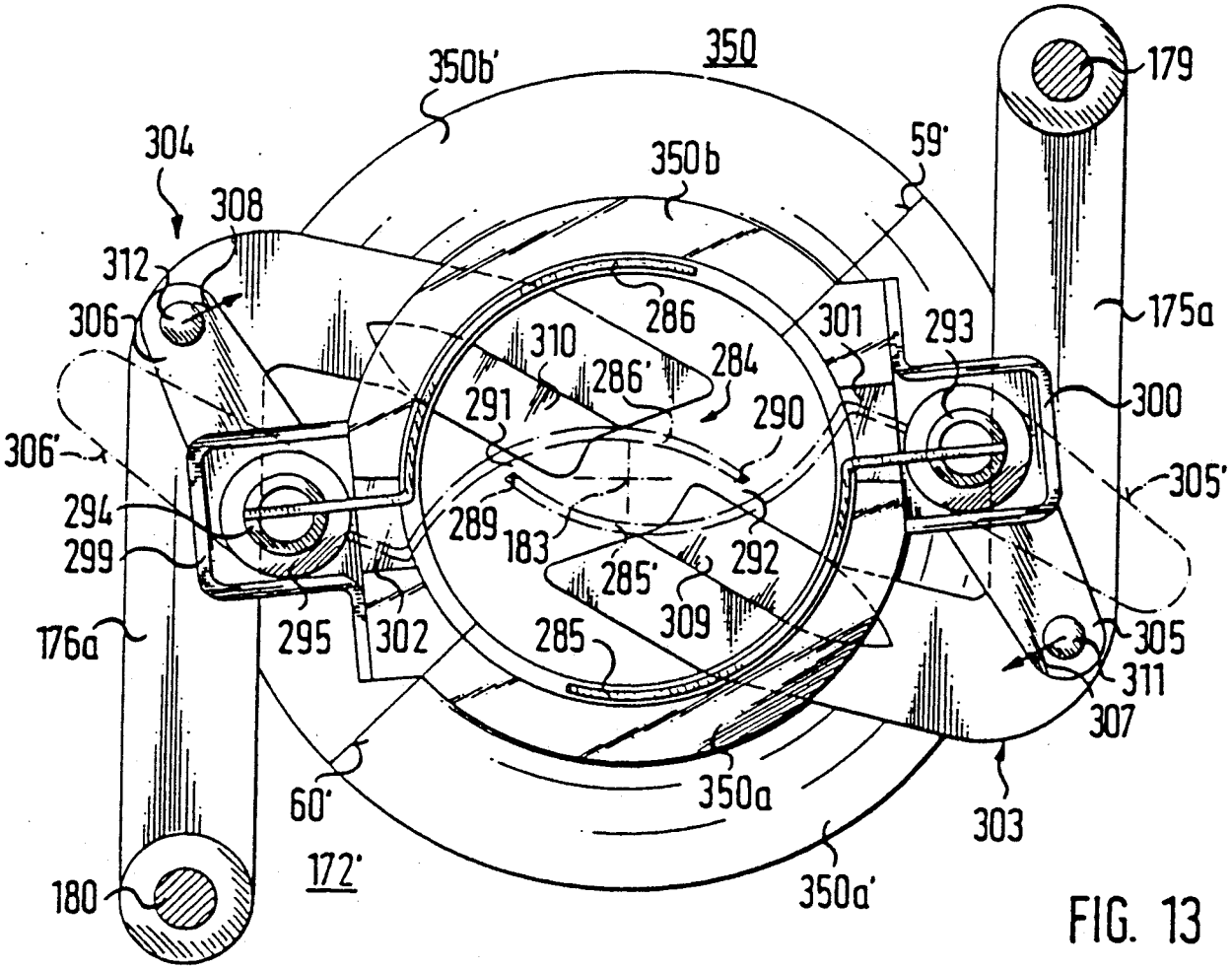
FIG. 13 is a top plan view of the gas guide chamber and the tube stabilizing device of a textile winding machine and showing a further additional embodiment of the yarn unwinding guide apparatus of the present invention.
Figure 14:
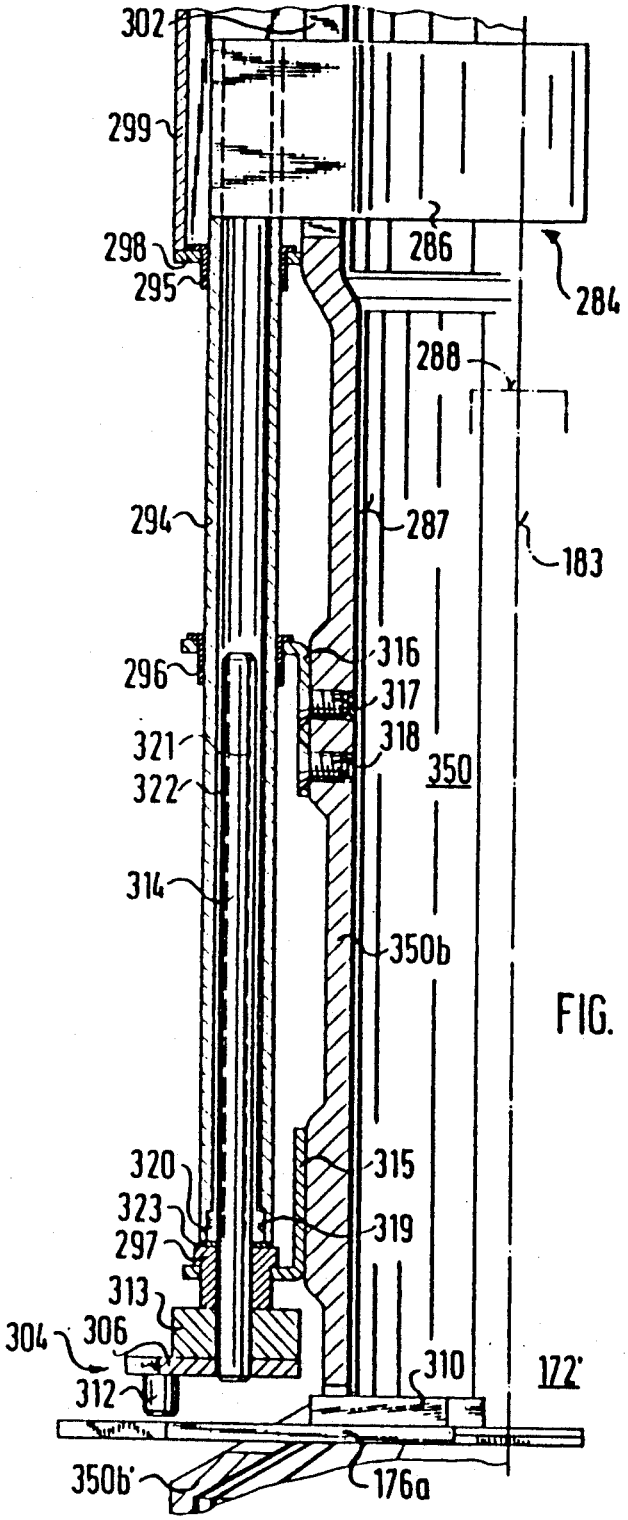
FIG. 14 is a vertical sectional view of the yarn unwinding guide apparatus shown in FIG. 13.

In FIGS. 13 and 14, a further additional embodiment of the yarn unwinding guide apparatus of the present invention is illustrated and is generally designated as 284. A gas guide chamber 350 is formed by a first chamber portion 350*a* and a second chamber portion 350*b*. The first chamber portion 350*a* includes a radially enlarged foot portion 350*a'* and the second chamber portion 350*b* includes a radially enlarged foot portion 350*b'*, the radially enlarged foot portions 350*a'*, 350*b'* being adapted to accommodate the cylindrical base plate of a tube support member. Additionally, an upper axial portion of the inner circumferential wall 287 of the chamber portions 350*a*, 350*b* which together form the inner circumferential wall 287 of the gas guide chamber 350, is radially enlarged by a relatively slight amount, as seen in FIG. 14.

The yarn unwinding guide apparatus 284 includes a first vertical plate 285 and a second vertical plate 286. The first vertical plate 285 is connected to a vertical shaft 293 and the second vertical plate 286 is connected to a vertical shaft 294. Each plate 285, 286 includes an arcuate portion compatibly configured with the inner circumferential surface 287 of the gas guide chambers 350. The plates 285, 286 are movable between a nonengaged disposition, shown in solid lines in FIG. 13, in which they are disposed in close contact with the enlarged upper portion of the inner circumferential wall 287 of the gas guide chamber 350 and a yarn engaging position, shown in broken lines 285', 286' in FIG. 13.

In their yarn engaging positions, the vertical plates 285, 286 form a yarn receiving area generally centered on the axis 183 of the gas guide chamber 350. The free ends 289 and 290 of the vertical plates 285 and 286 form longitudinal gaps 291 and 292 in cooperation with the opposing plates. As seen in FIG. 13, the vertical shaft 293 is disposed in an offset 300 integrally formed in the first chamber portion 350*a*. The vertical shaft 294 is disposed in an offset 299 integrally formed in the second chamber portion 350*b*. The first plate 285 extends from the offset 300 through a longitudinal slot 301 into the interior of the gas guide chamber 350. The second plate 286 extends from the offset 299 through a longitudinal slot 302 into the interior of the gas guide chamber 350.

As seen in FIG. 14, the vertical shafts 293, 294 such as, for example, the vertical shaft 294, extend downwardly from the respective offsets 299, 300 through conventional bearing members 295 which are supported by the bottom plates of the offsets such as, for example, the bottom plate 298. Additionally, each vertical shaft 293, 294 is rotatably supported by a conventional bearing member 296 which is supported by a bracket 316 fixedly connected to the respective chamber portion 350*a*, 350*b* by a pair of fastening bolts 317, 318.

The gas guide chamber 350 additionally includes a tube stabilizing apparatus 172' having an arm member and an opposing member such as a first arm 175*a* and a second arm 176*a* for compressively engaging a tube therebetween to stabilize the yarn package during the unwinding therefrom. The first arm member 175*a* is pivotally coupled to a vertical shaft 179 and the second arm member 176*a* is pivotally connected to a vertical shaft 180.

The vertical shafts 293, 294 for the vertical plates 285, 286 are operatively connected by a cam assembly for translating pivotal movement of the arm 175*a* to the vertical shaft 293 whereby the movement of the plates 285 and 286 is coordinated with the movement of the arms 175*a* and 176*a* of the tube stabilizing apparatus. As seen in FIG. 13, a first movement coordinating assembly 304 operatively interconnects the vertical shaft 294 with the second arm 176*a* and a second movement coordinating assembly 303 operatively interconnects the vertical shaft 293 with the first arm 175*a*. As seen in FIG. 14, the movement coordinating assemblies 304, 303, such as, for example, the first movement coordinating assembly 304, includes a rod 314 received in a hollow cylindrical axial bore of the vertical shaft 294. The vertical shaft 294 includes a pair of diametrically opposed longitudinal slots 321, 322 formed in its axial cylindrical bore extending from the bottom of the vertical shaft. The rod 314 includes a pair of diametrically opposed radially extending tabs 319, 320 which are received in the longitudinal slots 321, 322, respectively. Accordingly, the vertical shaft 294 is coupled to the rod 314 in a non-rotating, axially movable manner.

The rod 314 is rotatably received in a conventional bearing member 297 which is supported by a bracket 315 secured to the outer wall of the second chamber portion 350*b*. An actuating lever 306 is fixedly connected by a connecting foot member 313 to the bottom axial portion of the rod 314. A downwardly extending cam post 312 is fixedly connected to the other end of the actuating lever 306.

As seen in FIG. 13, an actuating lever 305 is fixedly connected to a rod (not shown) which is identical to the rod 314 and which extends into the vertical shaft 293. The actuating lever 305 includes a downwardly extending cam post 311.

The first arm 175*a* of the tube stabilizing apparatus 172' includes a cam guide portion 309 adjacent its free end. The second arm 176*a* includes a cam guide portion 310 formed adjacent its free end. The cam portion 309 of the first arm 175*a* is configured to engage the cam post 311 on the actuating lever 305 during movement of the first arm 175*a* from its disengaged position to its position for engaging the tube on the tube support device within the gas guide chamber 350. Similarly, the cam member 310 is configured to engage the cam post 312 of the actuating lever 306 during movement of the second arm 176*a* from its nonengaged disposition to its tube engaging disposition.

In operation, the vertical plates 285, 286 are disposed in their solid line position shown in FIG. 13, whereby the actuating levers 305, 306 are disposed in their nonengaged position shown by the broken lines 305', 306'. Upon pivoting of the first arm 175*a* and the second arm 176*a* about their respective vertical shafts 179, 180 from their nonengaged dispositions to their tube engaging dispositions, the cam member 309 contacts the cam post 311 and the cam member 310 contacts the cam post 312. Accordingly, the actuating levers 305, 306 are moved from their broken line positions 305', 306' to their solid line positions shown in FIG. 13 to thereby move the vertical plates 285, 286 to their nonengaging position 285', 286'.

Upon movement of the arms 175*a* and 176*a* from their respective tube engaging dispositions to their nonengaged dispositions, the cam members 309, 310 engage the cam posts 311, 312, respectively, to move the actuating levers 305, 306 to their nonengaged broken line positions 305', 306'. The vertical shafts 293, 294 can be biased by conventional biasing means, such as springs, to bias the actuating levers 305, 306 to pivot in a clockwise direction, such as indicated by the arrows 307, 308 in FIG. 13.

As seen in FIG. 14, the axial position of the vertical shaft 294 relative to the rod 314 can be adjusted by means of selected conventional shim ring members 323 having a throughbore which compressively engages the rod 314. The selected shim ring member 323 engage the bottom of the vertical shaft 294 to support the vertical shaft at a selected height relative to the rod 314 depending on the thickness of the selected shim. Accordingly, the height of the first plate 286 relative to the top surface 288 of a tube being unwound in the gas guide chamber 350 can be selectively adjusted.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine of the type having a plurality of independently movable tube support members for individually supporting tubes in generally upright dispositions, an unwinding device for unwinding, at an unwinding location, packages of textile material such as yarn or the like wound on tubes supported on the tube support members, a delivery assembly for delivering the tube support members to a preliminary location for feeding to the unwinding device, a discharge assembly for transporting tube support members from a discharge location to a further handling location and a yarn end loosening assembly having means for emitting streams of gas, a pair of chamber portions and means for moving the chamber portions between a clearance position for travel therepast of a tube support member along a cross path extending through the unwinding device and a chamber forming position in which the chamber portions are cooperatively disposed relative to one another to form a gas guide chamber at the unwinding location, the gas guide chamber encircling a yarn package supported by a tube support member to guide against the yarn package streams of gas emitted by the gas stream emitting means for loosening a yarn end of the yarn package, an apparatus for handling yarn during axial unwinding of the yarn from a yarn package in the gas guide chamber to control ballooning of the yarn, comprising: means mounted to at least one of the chamber portions for restricting laterally outward displacement of the yarn relative to the axis of unwinding at a location between the end of the tube and generally the top of the gas guide chamber, said restricting means including vertically extending plate means shaped to define a yarn receiving area within the lateral extent of the gas guide chamber for confining the path of the yarn being unwound, said plate means including means for guiding the yarn from the inner wall of the gas guide chamber into said yarn receiving area.

2. In a textile machine, a yarn handling apparatus according to claim 1 and characterized further in that said guiding means includes a first guide surface and a second guide surface forming a vertical opening therebetween and said plate means includes a surface extending continuously from said first guide surface to said second guide surface and defining said yarn receiving area.

3. In a textile machine, a yarn handling apparatus according to claim 2 and characterized further in that said first and second guide surfaces define a concave segment and said vertical spacing is formed generally at the midpoint of said concave segment, said first and second guide surfaces guiding the yarn toward said vertical opening.

4. In a textile machine, a yarn handling apparatus according to claim 1 wherein the unwinding device includes a yarn end engagement member for engaging a yarn end at a location above the gas guide chamber and for moving the engaged yarn in a lateral direction across the lateral extent of the gas guide chamber and characterized further in that said guiding means includes a first guide member and a second guide member spaced from one another to form a vertical opening permitting access into said yarn receiving area, the yarn end engagement member moving the engaged yarn into engagement with said first guide member through movement of the engaged yarn in the lateral direction, said second guide member extending laterally outwardly from said first guide member for engaging a yarn traveling beyond said first guide member to guide the yarn through said vertical opening into said yarn receiving area.

5. In a textile machine, a yarn handling apparatus according to claim 4 and characterized further in that said first guide member is inclined in the lateral direction for urging a yarn traveling therealong toward said second guide member.

6. In a textile machine, a yarn handling apparatus according to claim 4 and characterized further in that said first guide means is shaped to form three sides of a four sided yarn receiving area and said second guide member is shaped to form the fourth side of said four sided yarn receiving area.

7. In a textile machine, a yarn handling apparatus according to claim 4 and characterized further in that said second guide means is shaped to form two tines of a fork and said first guide means extends across said tines and forms said vertical opening with one of said tines.

8. In a textile machine, a yarn handling apparatus according to claim 1 and characterized further by means for moving said plate means laterally outwardly to an inoperative position out of yarn engagement.

9. In a textile machine, a yarn handling apparatus according to claim 8 wherein the chamber has an inner circumferential wall and characterized further in that said restricting means includes a pair of contoured members and said moving means includes means for moving said contoured members, each contoured member having an inner surface adapted to face the inner surface of the other contoured member and an outer surface having a curvature generally corresponding to the curvature of the inner circumferential wall of the gas guide chamber, said moving means moving said contoured members between said inoperative position in which the outer surfaces of said contoured members are in generally flush relation with the inner circumferential wall of the gas guide chamber and a yarn receiving area forming position in which the inner surfaces of said contoured members face one another to form a yarn receiving area.

10. In a textile machine, a yarn handling apparatus according to claim 9 wherein the unwinding device includes a tube stabilizing assembly having an arm member and an opposing member, the arm member being movable against a selected one of the tube and the tube support member and the opposing member engaging a selected one of the tube and the tube support member to stabilize the tube during the unwinding of yarn therefrom and characterized further in that said moving means includes at least one vertical shaft pivotally supported on one of the chamber portions, a respective one of said contoured members being connected to said vertical shaft for pivotal movement therewith, and means for pivoting said vertical shaft in response to movement of the arm member of the tube stabilizing assembly to effect movement of said respective contoured member between said inoperative position and said yarn receiving area forming position.

11. In a textile machine, a yarn handling apparatus according to claim 10 and characterized further in that said pivoting means includes a cam assembly having a cam member mounted to a selected one of said vertical shaft and the arm member and a cam follower member mounted to the other of said vertical shaft and the arm member, said cam assembly translating pivotal movement of the arm member to said vertical shaft.

12. In a textile machine, a yarn handling apparatus according to claim 8 wherein the chamber portions include at least one slot in a respective chamber portion and characterized further in that said restricting means includes means for supporting said plate means on the respective chamber portion outwardly of the gas guide chamber and extending through the slot into the gas guide chamber.

13. In a textile machine, a yarn handling apparatus according to claim 12 and characterized further in that said supporting means includes at least one vertical shaft pivotably supported on the respective chamber portion, said plate means is connected by connecting means to said vertical shaft for pivoting therewith and said moving means includes means for pivoting said vertical shaft to effect movement of said plate means between said inoperative position and said yarn receiving area forming position.

14. In a textile machine, a yarn handling apparatus according to claim 13 and characterized further in that said restricting means include at least one offset formed in the respective chamber portion to form a recess for receiving the extent of said plate means outwardly of the slot in the gas guide chamber, and said pivoting means is operable to pivot said plate means from said yarn receiving area forming position through the slot into said offset for disposition of said plate means therein in said inoperative position.

15. In a textile machine, a yarn handling apparatus according to claim 13 and characterized further by means for selectively adjusting the axial position of said plate means on said vertical shaft.

16. In a textile machine, a yarn handling apparatus according to claim 15 and characterized further in that said restricting means includes at least one offset formed in the respective chamber portion to form a recess for receiving the extent of said plate means outwardly of the slot in the gas guide chamber, and said pivoting means is operable to pivot said plate means from said yarn receiving area forming position through the slot into said offset for disposition of said plate means therein in said inoperative position and said means for adjusting the axial position of said plate means includes a height adjustment assembly movably connected to the respective chamber portion for axial movement relative thereto, said height adjustment assembly engaging said plate means to support said plate means at selected axial positions along said vertical shaft.

17. In a textile machine, a yarn handling apparatus according to claim 16 and characterized further in that said height adjustment assembly is disposed inwardly of the inner circumferential wall of the gas guide chamber and is formed with a curvature compatibly configured with the curvature of the inner circumferential wall.

18. In a textile machine, a yarn handling apparatus according to claim 12 and characterized further in that said restricting means include at least one offset formed in the respective chamber portion to form a recess for receiving the extent of said plate means outwardly of the slot in the gas guide chamber.

19. In a textile machine of the type having a plurality of independently movable tube support members for individually supporting tubes in generally upright dispositions, an unwinding device for unwinding, at an unwinding location, packages of textile material such as yarn or the like wound on tubes supported on the tube support members, a delivery assembly for delivering the tube support members to a preliminary location for feeding to the unwinding device, a discharge assembly for transporting tube support members from a discharge location to a further handling location and a yarn end engagement assembly including a movable suction tube communicated with a source of suction and having an open end for applying a suction flow therethrough at a yarn end drawing location to draw a yarn end of a wound package at the unwinding location into the suction tube for movement of the yarn end by the suction tube to a yarn splicing location and means for moving the suction tube between the yarn end drawing location and the yarn splicing location, an apparatus for stopping the suction applied through the open end of the suction tube in response to movement of the suction tube, comprising:

valve means including a throughbore, said valve means being pivotally mounted within the suction tube between the open end and the suction source for movement between a suction applying position in which said throughbore communicates the open end of the suction tube with the suction source and a stopping position in which said valve means restricts the passage of the suction flow therepast; and actuating means including a pivot lever connected to said valve means and a pivot lever engaging assembly for engaging said pivot lever during the movement of the suction tube therepast to effect movement of said valve means between said suction applying position and said stopping position.

20. In a textile machine, a yarn handling apparatus according to claim 19 and characterized further in that said valve means includes a ball valve member having said throughbore formed therethrough, said ball valve member having an outer surface portion compatibly configured with the suction tube and forming a clamping passage therewith and said ball valve member and the suction tube compressively securing a yarn end drawn into said clamping passage during movement of said valve means between said suction applying position and said stopping position.

21. In a textile machine of the type having a plurality of independently movable tube support members for individually supporting tubes in generally upright dispositions, an unwinding device for unwinding, at an unwinding location, packages of textile material such as yarn or the like wound on tubes supported on the tube support members, a delivery assembly for delivering the tube support members to a preliminary location for feeding to the unwinding device, a discharge assembly for transporting tube support members for a discharge location to a further handling location and a yarn end loosening assembly having means for emitting streams of gas, a pair of chamber portions and means for moving the chamber portions between a clearance position for travel therepast of a tube support member along a cross path extending through the unwinding device and a chamber forming position in which the chamber portions are cooperatively disposed relative to one another to form a gas guide chamber at the unwinding location, the gas guide chamber encircling a yarn package supported by a tube support member to guide against the yarn packages streams of gas emitted by the gas stream emitting means for loosening a yarn end of the yarn package, an apparatus for handling yarn traveling from the gas guide chamber, comprising:

means for engaging the traveling yarn to eliminate loops, snarls and the like, said engaging means including a pair of arm members, a pivot assembly for pivotally supporting said arms for opposed pivoting movement in a horizontal plane above the gas guide chamber, and means for pivoting said arm members toward one another into a guiding position in which said arm members form a yarn guiding opening therebetween for guiding of the traveling yarn and for pivoting said arm members away from one another to a non-engaging position, each arm member having a recess for cooperating with the recess of the other arm member to form said yarn guiding opening for guiding of the traveling yarn.

22. In a textile machine, a yarn handling apparatus according to claim 21 and characterized further in that said arm members partially overlap one another in said guiding position, one of said arm members includes a vertically extending stop portion and the other arm member includes an engaging portion for engaging said vertically extending stop portion of said one arm member to limit the extent of overlapping of said arm members.

23. In a textile machine, a yarn handling apparatus according to claim 21 and characterized further in that said recesses of said arm members partially overlap in said guiding position.

24. In a textile machine, a yarn handling apparatus according to claim 21 and characterized further in that said pivoting means includes a drive gear fixedly connected to one of said arm members, a driven gear fixedly connected to the other arm member, said drive gear and said driven gears being disposed in meshing engagement with one another to drivingly interconnect said arm members for synchronous pivoting movement, and means for driving said one arm member.

25. In a textile machine, a yarn handling apparatus according to claim 21 and characterized further by a yarn shearing assembly for shearing yarn traveling beyond said arm members.

26. In a textile machine, a yarn handling apparatus according to claim 25 and characterized further in that said yarn shearing assembly is mounted to one of said arm members.

27. In a textile machine, a yarn handling apparatus according to claim 26 and characterized further in that said yarn shearing assembly includes a fixed shear member fixedly mounted to said one arm member, and extending in superposed relation with said recess of said one arm member, a pivoting shear member pivotally mounted to said fixed shear member and means for pivoting said pivoting shear member for shearing the yarn.

* * * * *